US009833659B1

(12) United States Patent
Nicholas

(10) Patent No.: US 9,833,659 B1
(45) **Date of Patent: *Dec. 5, 2017**

(54) OMNIDIRECTIONAL EXERCISE PLATFORM AND METHOD OF USE

(71) Applicant: Paul James Nicholas, New York, NY (US)

(72) Inventor: Paul James Nicholas, New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/407,222

(22) Filed: Jan. 16, 2017

Related U.S. Application Data

(60) Division of application No. 14/954,906, filed on Nov. 30, 2015, now Pat. No. 9,545,539, which is a division of application No. 14/475,525, filed on Sep. 2, 2014, now Pat. No. 9,199,117, which is a continuation-in-part of application No. 13/186,127, filed on Jul. 19, 2011, now Pat. No. 8,827,879, said application No. 14/954,906 is a division of application No. 14/475,525, filed on Sep. 2, 2014, now Pat. No. 9,199,117, which is a continuation-in-part of application No. 29/494,559, filed on Jun. 22, 2014, now Pat. No. Des. 749,178.

(51) Int. Cl.

| | |
|---|---|
| ***A63B 22/20*** | (2006.01) |
| ***A63B 21/00*** | (2006.01) |
| ***A63B 23/12*** | (2006.01) |

(52) U.S. Cl.
CPC ..... *A63B 22/20* (2013.01); *A63B 21/0004* (2013.01); *A63B 23/1236* (2013.01)

(58) Field of Classification Search
CPC ..... A63B 22/20; A63B 21/00; A63B 23/0211; A63B 21/1469; A63B 2208/0219; A63B 22/203; A63B 23/03541; A63B 21/1484; A63B 23/1236; A63B 2071/025
USPC ..... 482/44–50, 92, 129, 131–132, 141–142, 482/148, 907; 16/9, 14, 18 R, 20–21, 16/24–26, 42 R, 45, 107; D21/662
See application file for complete search history.

(56) References Cited

U.S. PATENT DOCUMENTS

| | | | |
|---|---|---|---|
| 1,824,920 | A | 9/1931 | Novak |
| 2,124,123 | A | 7/1938 | Rosengarten |
| 2,467,603 | A | 4/1949 | Stewart |
| D204,752 | S | 5/1966 | Tveten |

(Continued)

FOREIGN PATENT DOCUMENTS

WO WO 2007/112495 A1 10/2007

*Primary Examiner* — Andrew S Lo
(74) *Attorney, Agent, or Firm* — Allen D. Hertz, P.A.; Allen D. Hertz

(57) ABSTRACT

An omnidirectional exercise platform includes a base member, a contact surface and three ball transfer units. The contact surface is carried by a top surface of the base member. The three ball transfer units are coupled to a bottom surface of the base member. The three ball transfer units are arranged having an equal angular offset therebetween providing stability to the exercise platform during use. The ball transfer units each comprise a hemispherical housing, a primary ball member and a plurality of secondary ball members disposed between an inner surface of the hemispherical housing and the primary ball member. The base member can include an upper body member and a lower body member. The pad member can be manufactured of a pliant material. Features of the pad member can identify a stability region of the exercise platform. The platform can have a convex arched top surface.

20 Claims, 16 Drawing Sheets

(56) References Cited

U.S. PATENT DOCUMENTS

| | | | |
|---|---|---|---|
| 3,401,421 | A | 9/1968 | Aninger |
| 3,478,382 | A | 11/1969 | Nosenzo |
| 3,752,475 | A | 8/1973 | Ott |
| 3,809,393 | A | 5/1974 | Jones |
| 4,134,584 | A | 1/1979 | Rosenbusch |
| 4,171,805 | A | 10/1979 | Abbott |
| 4,402,108 | A | 9/1983 | Pannwitz |
| 4,856,134 | A | 8/1989 | Wertz |
| 4,892,305 | A | 1/1990 | Lynch |
| D346,621 | S | 5/1994 | Dial |
| D353,640 | S | 12/1994 | Huang |
| D353,858 | S | 12/1994 | Huang |
| 5,632,707 | A | 5/1997 | Daniel et al. |
| 6,038,734 | A | 3/2000 | Facchin |
| 6,093,159 | A | 7/2000 | Racoosin |
| D498,668 | S | 11/2004 | Counts |
| D507,026 | S | 7/2005 | Chen |
| D507,608 | S | 7/2005 | Chen |
| 6,942,605 | B1 | 9/2005 | Sukhovitsky |
| D517,136 | S | 3/2006 | Chen |
| D519,172 | S | 4/2006 | Penat |
| D527,428 | S | 8/2006 | Cooper |
| D562,918 | S | 2/2008 | Tuller |
| 7,621,858 | B2 | 11/2009 | Sheron |
| D612,896 | S | 3/2010 | Talley |
| D612,897 | S | 3/2010 | Lamont |
| D631,106 | S | 1/2011 | Zemel |
| D643,475 | S | 8/2011 | Stewart |
| D680,599 | S | 4/2013 | Orenstein |
| D682,374 | S | 5/2013 | Wilkinson |
| 8,790,307 | B2 | 7/2014 | Amirouche |
| D717,377 | S | 11/2014 | Orenstein |
| D717,381 | S | 11/2014 | Orenstein |
| 8,882,645 | B2 | 11/2014 | Baptiste |
| 8,899,604 | B2 | 12/2014 | Orenstein |
| D724,162 | S | 3/2015 | James |
| 2003/0131444 | A1 | 7/2003 | Koguchi |
| 2005/0049123 | A1 | 3/2005 | Dalebout |
| 2006/0014615 | A1 | 1/2006 | Godbold |
| 2007/0184951 | A1 | 8/2007 | James et al. |
| 2007/0298947 | A1 | 12/2007 | Eksteen |
| 2008/0200318 | A1 | 8/2008 | Hauser et al. |
| 2009/0298656 | A1 | 12/2009 | Dannenberg |
| 2009/0305853 | A1 | 12/2009 | Jordan |
| 2010/0004105 | A1 | 1/2010 | Peddar |
| 2010/0130337 | A1 | 5/2010 | Stewart |
| 2010/0261590 | A1 | 10/2010 | Fares |
| 2010/0267533 | A1 | 10/2010 | Susnjara |
| 2010/0317496 | A1 | 12/2010 | Abranchess |
| 2011/0065555 | A1 | 3/2011 | Moskowich |
| 2011/0118088 | A1 | 5/2011 | Caya |
| 2011/0166006 | A1 | 7/2011 | Howard |
| 2012/0083396 | A1 | 4/2012 | Aquino |
| 2013/0023391 | A1 | 1/2013 | Nicholas |
| 2014/0162858 | A1 | 6/2014 | Dalebout |
| 2015/0273274 | A1 | 10/2015 | Agostini |

OMNIDIRECTIONAL EXERCISE PLATFORM AND METHOD OF USE

CROSS-REFERENCE TO RELATED APPLICATIONS

This Non-Provisional Patent Application is:

A. a Divisional Patent Application claiming the benefit of U.S. Utility patent application Ser. No. 14/954,906, filed on Nov. 30, 2015 (Scheduled to issue as U.S. Pat. No. 9,545,539 on Jan. 17, 2017), which is a Divisional Patent Application claiming the benefit of U.S. Utility patent application Ser. No. 14/475,525, filed on Sep. 9, 2014 (Now U.S. Pat. No. 9,199,117, issued on Nov. 30, 2015), which is a Continuation-In-Part claiming the benefit of: U.S. Utility patent application Ser. No. 13/186,127, filed on Jul. 19, 2011 (Now U.S. Pat. No. 8,827,879, issued on Sep. 9, 2014), B. a Divisional Patent Application claiming the benefit of U.S. Utility patent application Ser. No. 14/954,906, filed on Nov. 30, 2015 (Scheduled to issue as U.S. Pat. No. 9,545,539 on Jan. 17, 2017), which is a Divisional Patent Application claiming the benefit of U.S. Utility patent application Ser. No. 14/475,525, filed on Sep. 9, 2014 (Now U.S. Pat. No. 9,199,117, issued on Nov. 30, 2015), which is a Continuation-In-Part claiming the benefit of U.S. Design Patent Application Ser. No. 29/494,559, filed on Jun. 22, 2014 (Now U.S. Design Pat. D749,178, issued on Feb. 9, 2016), C. wherein each of the above identified applications are hereby incorporated by reference herein in their entireties.

FIELD OF THE INVENTION

The present disclosure generally relates to exercise devices. More particularly, the present disclosure relates to an exercise platform that provides for omnidirectional movement of the platform while performing various exercises.

BACKGROUND OF THE INVENTION

Over the years physical exercise has grown in popularity to improve the health and physical appearance of a person and also to reduce stress. There are a many forms of physical exercise that may be employed by a person such as: strength training, aerobics, calisthenics, and plyometrics to name a few. A common strength training exercise is the traditional push-up. In performing a push-up, a user assumes a prone position, and lifts the body using the arms. Through this exercise, the weight of the body serves as the main source of resistance to the muscles, particularly the pectoralis muscles, which are used in performing the push-up. However, greater muscle training efficiency may be obtained by activating additional muscle groups while performing the push-up. This is accomplished by modifying the standard up-down motion of the push-up to include various secondary movements such as: leg raises, one-armed push-ups, various hand positions, hip raises and the like. By using such modifications, the user activates various secondary muscle groups, which in turn significantly increase the effectiveness of the physical exercise.

Additionally, exercise efficiency can be further enhanced by random activation of these secondary muscle groups, which induces muscle confusion. It is known that performing the same exercise over and over cause the human body to adapt to these exercise motions and thereby causing a diminishing return by performing the same exercise repeatedly. Consequently, by employing muscle confusion that randomly activates various secondary muscle groups during a particular exercise, the human body is less likely to adapt to the exercise motions and thus receives greater benefit from the exercise.

There are several known devices in the prior art that seek to enhance the overall effectiveness of performing various exercises and in particular the traditional push-up. These devices commonly seek to facilitate one or more secondary motions, which in turn activate additional muscle groups during the core exercise. One known solution provides a platform having base member and a handle member that rotate with respect to each other along a vertical axis. The base member has a non-slip surface that engages a floor surface and prevents the device sliding along the floor. While this known solution is somewhat useful, it presents substantial drawbacks. Firstly, this device only permits the handle member to rotate which in turn allows the arms of a user to twist during the push-up. Although this does engage some secondary muscle groups, this rotation of the hand position generally focuses on the smaller muscles of the forearm and upper arm. Secondly, this device does not permit lateral motion of the device along the floor surface and thereby fails to activate many secondary muscle groups in the shoulders, chest, and back of a person during the exercise motion.

Another known solution provides an exercising device that includes a platform and a number of peripherally spaced caster wheels underneath the platform, for supporting a limb of a user on or against a supporting surface while permitting movement of the limb in any direction along the supporting surface. The platform has a lower body part that carries the caster wheels, and a removable upper part, which can be removed or inverted to change the configuration of the upper surface of the platform. Straps are provided to secure the device to the limb of a user. While this known solution is somewhat useful, it presents substantial drawbacks. To begin, the device uses a plurality of caster wheels that must be pushed or pulled to orientate each caster in the same direction. Then when a directional change is desired, the user must apply additional force to get the plurality of casters change direction and align in the new direction. This additional force requirement induces an inconsistency in the exercise motion. Further, this device does not facilitate a smooth uniform exercise motion because the multiple casters must realign prior to changing direction. Next, this device employs casters having a wheel/ball member that is supported by thru axle coupled to the frame of the caster. This configuration is likely to have increased axle friction under load and thus does not facilitate free motion.

Various exercise devices are known that employ a plurality of ball and cup-type members coupled to a bottom surface of the device and while somewhat useful these known solutions present substantial drawbacks. In these known solutions, there is generally provided a plurality of ball members that are rotationally coupled into a hemispherical cup formed within a housing member. The ball members are free to rotate in any direction with respect to the hemispherical cup. These known solutions, while providing some benefit, have a substantial drawback of increased friction between the ball member and hemispherical cup under load conditions. This type of ball motion assembly has a substantial portion of the ball member surface area in sliding contact with the surface area of the hemispherical cup and thereby restricts the free motion of the ball with respect to the cup under load. Moreover, in these known solutions, as a user increases the load on the device the induced additional friction between the ball and cup prevent the fluid multi-directional movement of the exercise device.

In another known exercise device that provides a hemispherical support frame and a single rigid support ball mounted to the support frame with a plurality of smaller low-friction ball bearings disposed in between the support ball and the support frame such that the support ball is freely rotatable in any direction. While this known solution is somewhat useful, it presents substantial drawbacks. Most significantly, this device only provides a single support ball, which causes the hemispherical support frame to be unstable during use. As discussed above, having and exercise device that permits a user to activate secondary muscle groups is advantageous. However, the exercise device must provide a stable platform by which the exercise can be safely performed and which reduces the possibility of injuring the user. Although this known exercise device provides a platform that facilitates fluid multi-directional movement during use, this device inherently presents an increased risk of potential injury to the user. The device has a high center of rotation between the support ball and hemispherical support frame. During use, this high center of rotation is likely to cause an undesired change in direction, due to the instability of the device, which may injure the hand, wrist, foot, or ankle of a user. For example, during a push-up it is beneficial to have the freedom of motion to laterally translate the hand position of the user (i.e., left/right/fore/aft) with respect to the starting position of the hands. It is also beneficial to have the freedom of rotational movement with respect to a vertical axis normal to a supporting floor surface. However, this known device permits a freedom of rotational movement with respect to a horizontal axis parallel to the supporting floor surface. This horizontal freedom of movement causes a twisting/torquing of the wrist joint of the user, which in turn is likely to result in a significant and painful injury to the user. In another example, this known device may be used for hamstring raises where the user places their feet on the hemispherical support frame to exercise their hips, hamstrings and core. As discussed above, this known solution presents a similar risk of injury to the ankle of the user, due to the horizontal freedom of movement, which can induce an undesired twisting/torquing of the ankle joint.

Additionally, the number of rolling support elements, (i.e. wheels) and the shape of the platform can impact the stability of the device. Three points always define a plane. Platform style exercise devices having a single roller provide no level stability and require that the exercising individual exert excess effort to maintain a stable orientation of the device. Without the extra effort, the device can change the orientation of the limb contacting the device in an undesirable manner. Platforms comprising two wheels introduce a very limited stability along an axis between the two wheels, but remain unstable about a rotational axis defined by the two wheels. Platforms comprising four or more wheels can include one or more wheels that are not coplanar. Therefore, the platform can rock about an axis defined by the two lowest wheels. Regarding the shape of the device, the area defined as a stability region, or a region that is within a boundary defined by contact points of three or more rolling elements ensures that the platform will not flip, and will thus remain in a desire orientation (generally horizontal) during use.

Efforts to provide an omnidirectional exercise platform that overcomes the drawbacks in the prior art have not met with significant success to date. As a result, there is a need in the art for an exercise platform that provides smooth, fluid omnidirectional movement of the platform and concurrently provides a stable platform that reduces the risk of injuring the user.

SUMMARY OF THE INVENTION

The basic inventive concept provides an omnidirectional exercise platform that permits free multi-directional translation of the platform with respect to a support surface, and further permits rotational movement with respect to a vertical axis normal to the support.

From an apparatus aspect, the invention comprises an omnidirectional exercise platform for facilitating a physical training exercise. The platform includes a base member having a top surface, an opposing bottom surface and at least one sidewall disposed there between. A plurality of apertures is formed into the bottom surface of the base member and extending towards the top surface of the base member. A pad member having a top surface, an opposing bottom surface and at least one sidewall disposed there between is coupled to the top surface of the base member. Each individual ball transfer unit is coupled within one of the plurality of apertures formed into the bottom surface of the base member, such that the plurality of ball transfer units substantially reduces rolling resistance when the omnidirectional exercise platform is loaded over a support surface during the physical training exercise.

From a system aspect, an omnidirectional exercise system is disclosed comprising a pair of omnidirectional exercise platforms for facilitating a physical training exercise. Each platform includes a base member having a top surface, an opposing bottom surface and at least one sidewall disposed there between. A plurality of apertures is formed into the bottom surface of the base member and extending towards the top surface of the base member. A pad member having a top surface, an opposing bottom surface and at least one sidewall disposed there between is coupled to the top surface of the base member. Each individual ball transfer unit is coupled within one of the plurality of apertures formed into the bottom surface of the base member, such that the plurality of ball transfer units substantially reduces rolling resistance when the omnidirectional exercise platform is loaded over a support surface during the physical training exercise.

From a method aspect, a method of fabricating an omnidirectional exercise platform for facilitating a physical training exercise, comprising the steps of: providing a base member having a top surface, an opposing bottom surface and at least one sidewall disposed there between; forming a plurality of apertures into the bottom surface of the base member and extending towards the top surface of the base member; coupling a pad member to the top surface of the base member, the pad member having a top surface, an opposing bottom surface and at least one sidewall disposed there between; and coupling each individual ball transfer unit of a plurality of ball transfer units within one of the plurality of apertures formed into the bottom surface of the base member, wherein the plurality of ball transfer units substantially reduces rolling resistance when the omnidirectional exercise platform is loaded over a support surface during the physical training exercise.

For a fuller understanding of the nature and advantages of the present invention, reference should be made to the ensuing detailed description of the preferred embodiments taken in conjunction with the accompanying drawings.

BRIEF DESCRIPTION OF THE DRAWINGS

The components in the figures are not necessarily to scale, emphasis instead being placed upon illustrating the principles of the invention. The invention will now be described, by way of example, with reference to the accompanying drawings, in which.

In the figures, like reference numerals designate corresponding elements throughout the different views of the drawings.

DETAILED DESCRIPTION OF THE PREFERRED EMBODIMENTS

Figure 1:
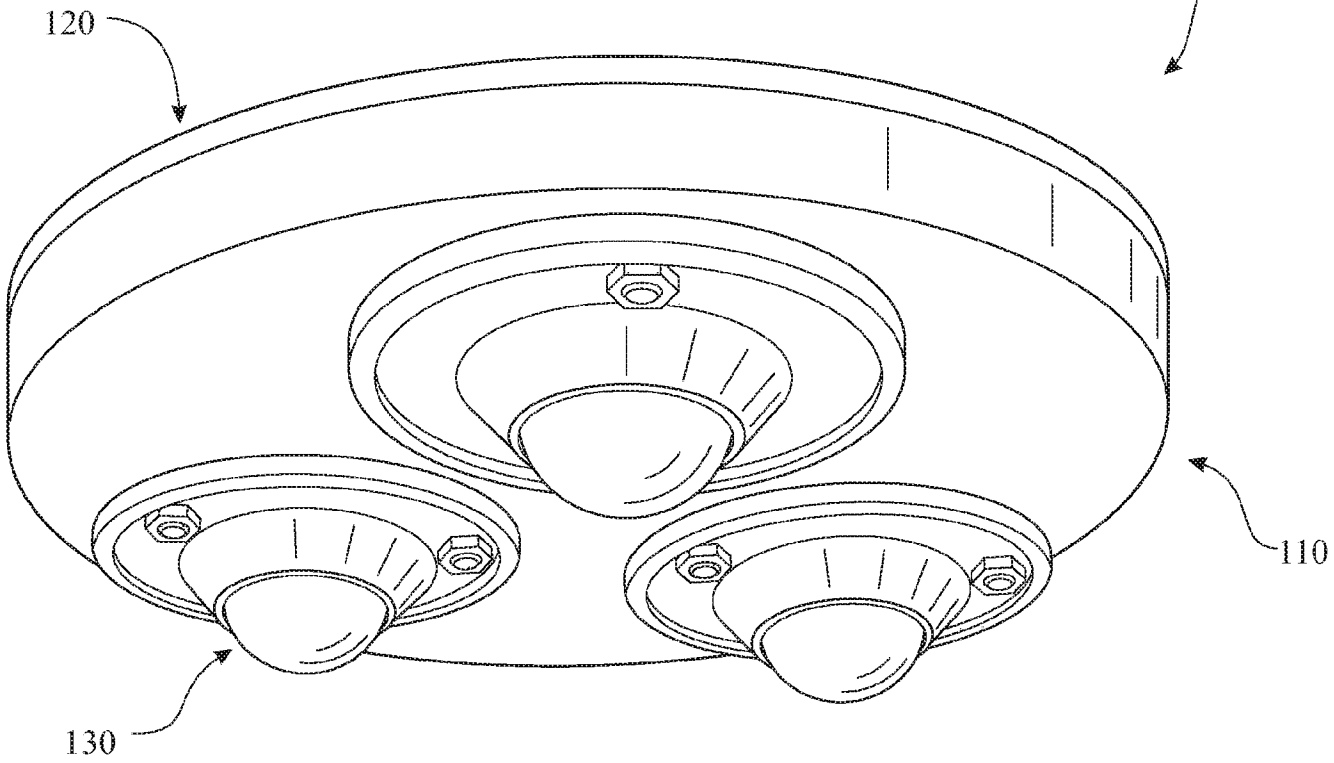
FIG. 1 presents an isometric bottom view of a first exemplary embodiment of an omnidirectional exercise platform in accordance with the present invention.
Figure 2:
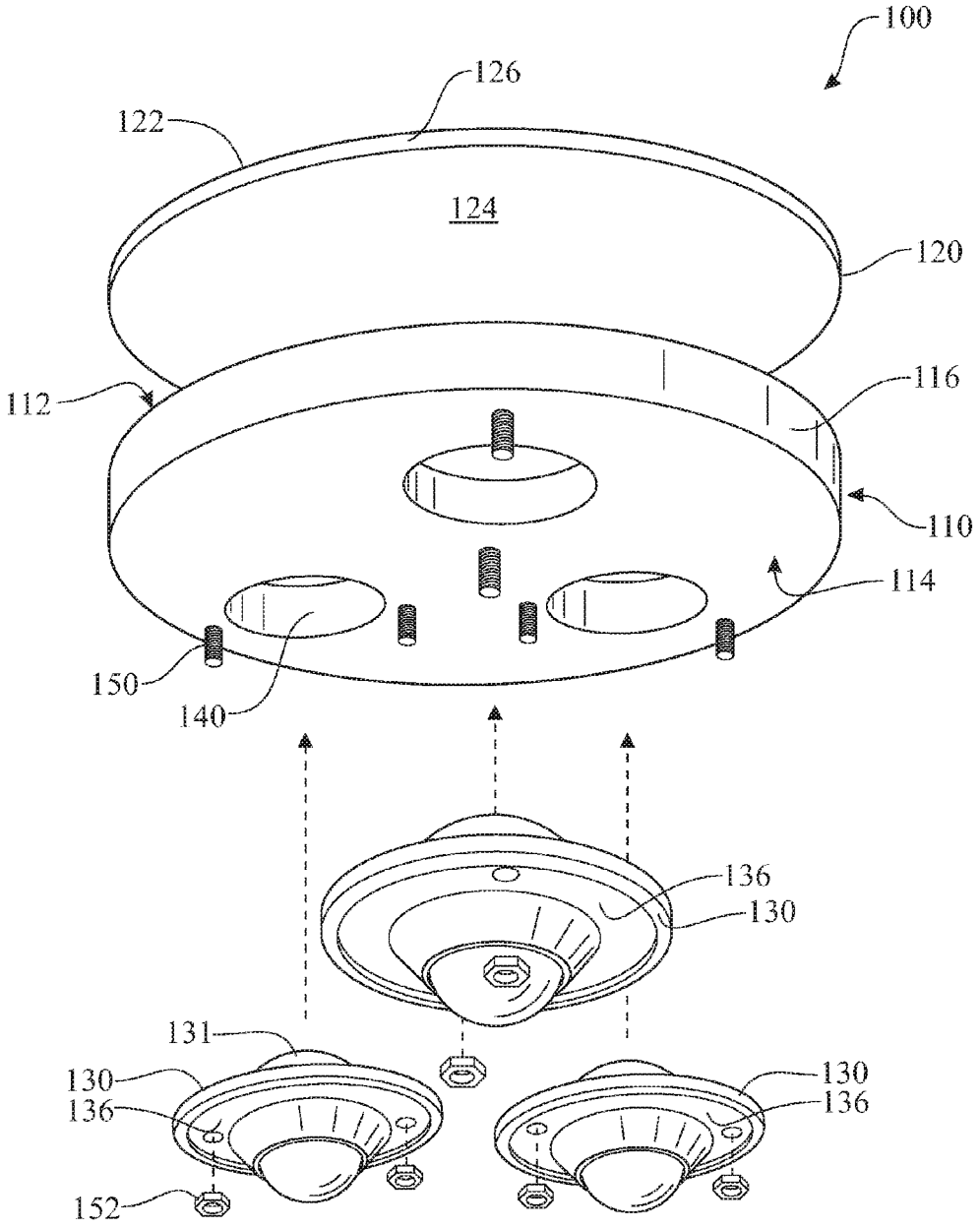
FIG. 2 presents an isometric exploded assembly view of the exemplary embodiment originally introduced in FIG. 1.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. In other implementations, well-known features and methods have not been described in detail so as not to obscure the invention. For purposes of description herein, the terms "upper", "lower", "left", "right", "front", "back", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments that may be disclosed herein are not to be considered as limiting, unless the claims expressly state otherwise.

A first exemplary embodiment of an omnidirectional exercise platform 100 is described in various illustrations presented in FIGS. 1 through 4. The omnidirectional exercise platform 100 includes a base member 110, a pad or contacting member 120 and a plurality of ball transfer units 130. In this exemplary embodiment, features of the base member 110 are referenced by a bottom surface 114, a top surface 112 located on a side opposite of the bottom surface 114, and at least one sidewall 116 extending circumferentially there between. The base member 110 can be fabricated from any suitable rigid material such as plastic, wood, metal, and the like or combinations thereof. The base member 110 can be fabricated using any suitable manufacturing process, such as casting, injection molding, machining, stamping, carving, vacuum forming, and the like. It is noted that one of ordinary skill in the art would readily appreciate these various manufacturing processes, which are not described in detail herein so as not to obscure the invention. The base member 110 is shown having a generally circular shape; however, it is understood that the base member 110 can be shaped having any other suitable geometric profile configuration such as oval, triangular (such as a triangular shaped omnidirectional exercise platform 500 described below), multi-sided polygons, and the like. A plurality of ball transfer unit receiving apertures 140 are formed into the bottom surface 112 of the base member 110. Each ball transfer unit receiving aperture 140 is configured to accept a portion of a ball transfer unit housing 131 of a respective ball transfer unit 130 therein. In the exemplary embodiment, the ball transfer units 130 are secured to base member 110 using one or more mechanical fasteners 150, such as a screw and an associated nut 152. Each mechanical fastener 150 is preferably inserted through an attachment aperture (not identified) of a mounting feature 136 of the respective ball transfer unit 130 and a corresponding fastener receiving aperture (not identified) passing through the base member 110. Alternatively, the ball transfer units 130 can be assembled to the base member 110 by any other suitable mechanical configurations including as a press fit assembly design, a snap-ring, an adhesive bonding process, and the like or any suitable combinations thereof. Features of the pad member 120 are referenced by a bottom surface 124, a top surface 122 located on a side opposite of the bottom surface 124, and at least one sidewall 126 extending circumferentially there between. The pad member 120 can be fabricated from a pliant or semi-rigid plastic or polymer material to provide a cushioned support or engage surface to enhance user comfort and grip during use. In one embodiment, the pad member 120 is fabricated from a neoprene rubber. The bottom surface 124 of pad member 120 is assembled to the top surface 112 of base member 110 by any of a variety of known mechanical assembly interfaces, including: adhesive, snaps, buttons, clips, clasps, press fit, dense hook and loop tape, and the like.

Figure 3:
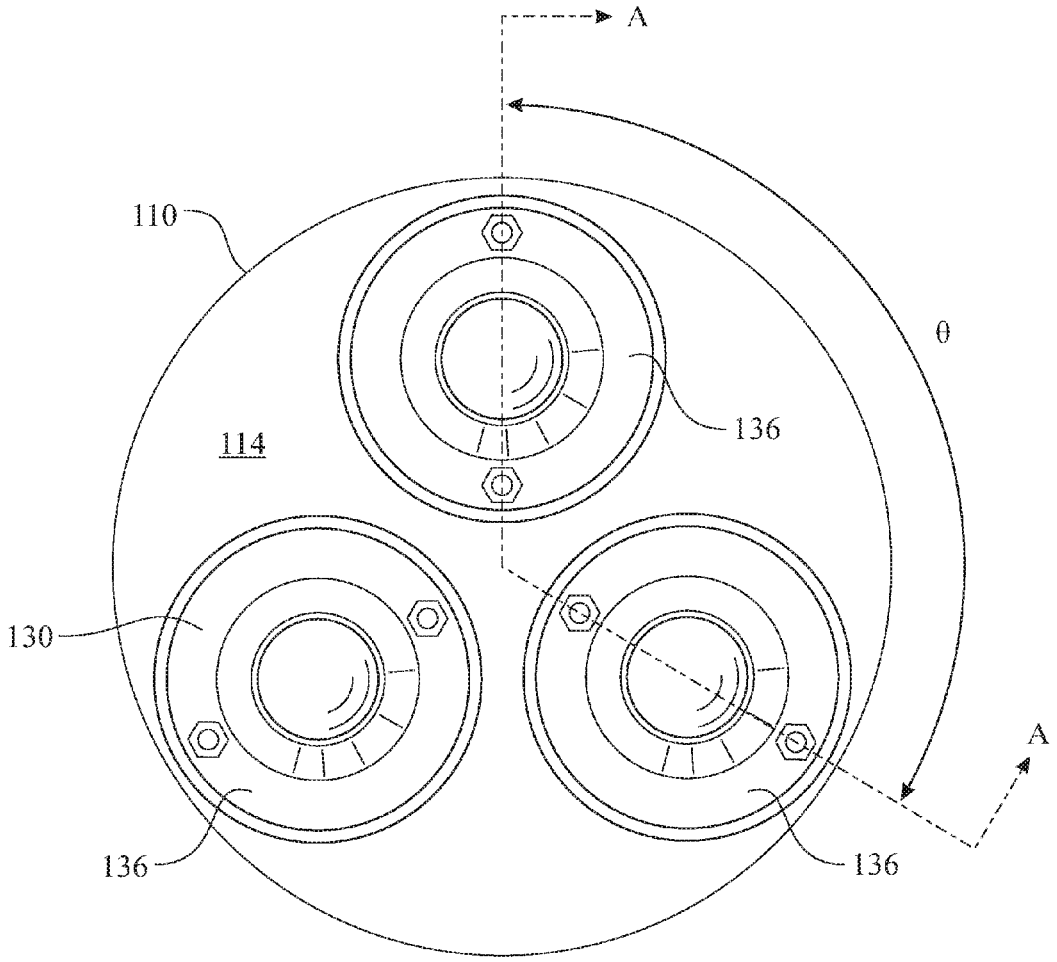
FIG. 3 presents a bottom assembly view of the exemplary embodiment originally introduced in FIG. 1.
Figure 8:
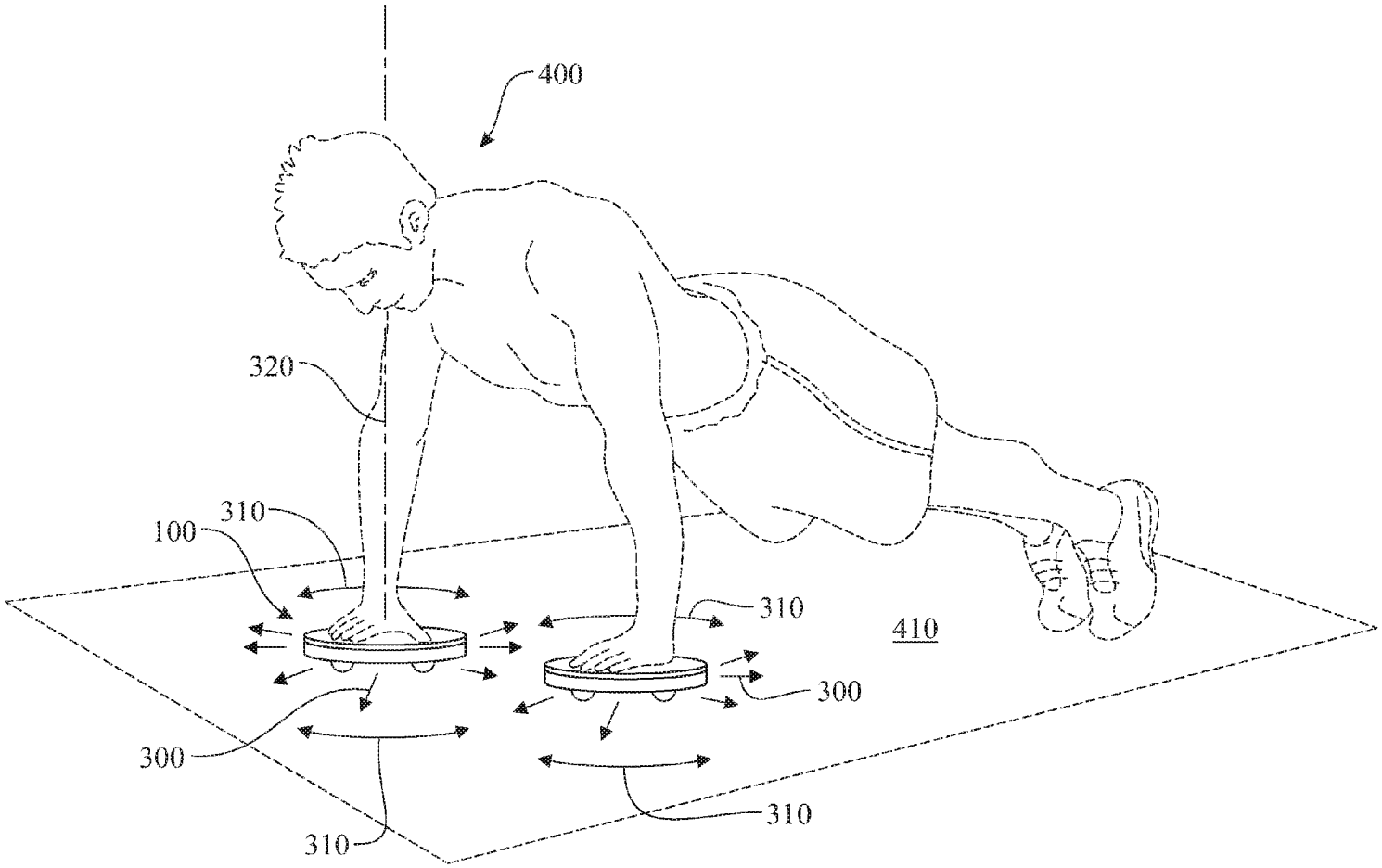
FIG. 8 presents a perspective view of the exemplary embodiment originally introduced in FIG. 1, wherein the omnidirectional exercise platform is shown in use during a push-up exercise.

A bottom view of the omnidirectional exercise platform 100 is presented in FIG. 3. The illustrated view introduces an angular offset θ between two adjacent ball transfer units 130. In this exemplary embodiment, the base member 110 is configured as a circular structure. To provide a stable platform in use, the ball transfer units 130 are preferably arranged having an angular offset θ that equals about 120 degrees. The angular offset θ was determined by dividing 360 degrees by the quantity of ball transfer units 130 being used; in the exemplary embodiment, three (3) ball transfer units 130 are incorporated into the design to optimize stability on any suitable surface 810 (FIG. 8). Should one of ordinary skill in the art desire to use more ball transfer units 130, the angular offset θ would be adjusted accordingly (e.g., 4 ball transfer units would have an angular offset θ of 90 degrees). In other alternate embodiments having different geometric configurations, the ball transfer units 130 may be arranged differently. It would be understood by those skilled in the art that the location of each ball transfer unit 130 of the plurality of ball transfer units 130 preferably be determined to enhance and maintain stability of the base member 110 during use. For example, in an alternate embodiment where base member 110 is configured as an oval, there would be 4 ball transfer units 130 employed with one ball transfer unit 130 located along and adjacent to each end of the minor and major axis. In another alternate embodiment where base member 110 is configured as a square there would preferably be a ball transfer unit 130 located adjacent each corner of the square.

Figure 4:
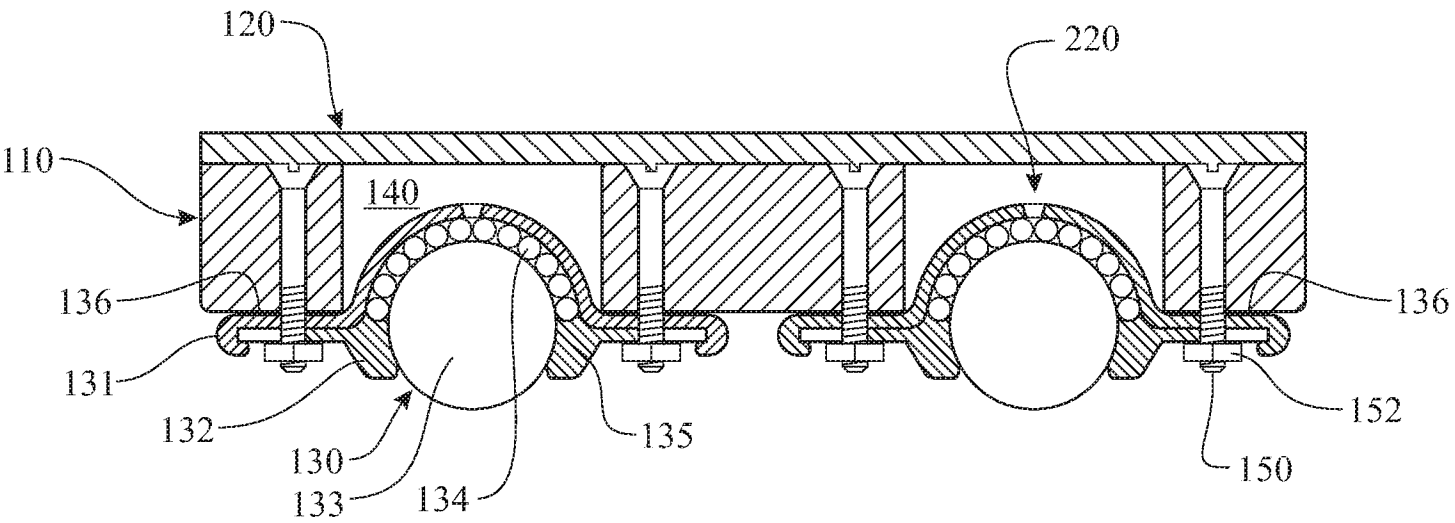
FIG. 4 presents a sectioned elevation view of the omnidirectional exercise platform originally introduced in FIG. 1, wherein the section is taken along section line A--A of FIG. 3.

A cross-sectional view of the omnidirectional exercise platform 100 is illustrated in FIG. 4 detailing a method and associated components for assembling two (2) ball transfer units 130 to the base member 110. The assembly method employs mechanical fasteners 152 (more specifically threaded members such as screws, bolts, studs, and the like) and respective nuts 150. Each exemplary ball transfer unit 130 generally comprises a housing 131, a retention member 132, a primary ball member 133, a plurality of secondary roller bearing elements 134 and a retention ring 135. In one exemplary embodiment, each ball transfer unit receiving aperture 140 is sized and configured to accept therein a hemispherical portion of the ball transfer unit housing 131. The ball transfer unit housing 131 and the primary ball retention member 132 are coupled together to form a cavity for retaining primary and secondary ball members therein. Further, the ball transfer unit housing 131 and the primary ball retention member 132 can be coupled using various manufacturing processes such as crimping, press fit, adhesive bonding, mechanical fasteners and other well known element coupling processes. Captured between the ball transfer unit housing 131 and retention member 132 are a plurality of secondary roller bearing elements 134, a primary ball member 133 and a retention ring 135. Secondary roller bearing elements 134 engage a concave inner surface of the ball transfer unit housing 131. The primary ball member 133 is assembled within the ball transfer unit housing 131 and engages with opposing surfaces of the secondary roller bearing elements 134. A retention ring 135 is assembled surrounding the primary ball member 133 and entraps and retains a plurality of secondary roller bearing elements 134 within a concave region of the hemispherically shaped ball transfer unit housing 131. The retention member 132 captures the retention ring 135, secondary roller bearing elements 134 and primary ball member 133 to complete an operative ball transfer unit 130 assembly.

The ball transfer unit 130 configuration disclosed herein permits rapid omnidirectional movement of each primary ball member 133 with significantly reduced friction under high load conditions. The reduced friction and smooth omnidirectional movement provided by each ball transfer unit 130 is enabled by reducing the contact surface area between the primary ball member 130 and the concave inner surface of the ball transfer unit housing 131. The reduction of this dynamic surface contact area is primarily effectuated by employing a plurality of secondary roller bearing elements 134 between the primary ball member 130 and the concave inner surface of the ball transfer unit housing 131, which provides both a load path and dynamic moving contact point there between.

In one exemplary embodiment, the ball transfer unit housing 131 is configured with one or more apertures 138 formed there through. The size and location of apertures 138 may vary depending on the style of ball transfer unit 130 employed. The one or more apertures 138 enables cleaning and maintaining of the ball transfer unit 130, thereby extending the operational lifespan of the ball transfer unit 130. In one embodiment, each one or more aperture 138 may be sized such that internal contaminants such as dust, dirt, lint, fibers, fluid and the like can pass through the aperture 138 and away from the ball transfer unit housing 131. In this embodiment, the aperture 138 can be sized slightly smaller that secondary roller bearing elements 134 but large enough to provide sufficient access to the inner surface of the ball transfer unit housing 131 to thereby facilitate cleaning and lubricating procedures.

Both the ball transfer unit housing 131 and the retention member 132 may be fabricated from various structural materials capable of providing adequate performance for a given load range. In one exemplary embodiment, the ball transfer unit housing 131 and the retention member 132 are fabricated from stainless steel. Alternatively, the ball transfer unit housing 131 and the retention member 132 can be fabricated from a zinc plated sheet of formed metal. It is understood that primary ball members 133 and the secondary roller bearing elements 134 can be precision ground and heat-treated such that surface imperfections and friction between the primary ball members 133 and the secondary roller bearing elements 134 are minimized. In one exemplary embodiment, the retention ring 135 can be fabricated from a polymer having high lubricity characteristics such as Polyoxymethylene (POM), also known as acetal, polyacetal and polyformaldehyde, is an engineering thermoplastic used in precision parts requiring high stiffness, low friction and excellent dimensional stability. As with many other synthetic polymers, it is produced by different chemical firms with slightly different formulas and sold under trade names such as DELRIN, CELCON, RAMTAL, DURACON AND HOSTAFORM, which are well-known materials used in component manufacturing. However, one of ordinary skill in the art would readily understand the various material substitutions, including any of many other suitable materials that may be employed.

In one exemplary embodiment the primary ball member 133 and/or secondary roller bearing elements 134 can be fabricated from any suitable material such as stainless steel, metal alloys, Teflon, nylon, polymers, composites, ceramics, and the like, or any combination thereof. It is understood that that primary ball member 133 can be selected from a material that prevents adversely marking, scuffing or scratching a floor support surface such as hardwood or tile.

Figure 5:
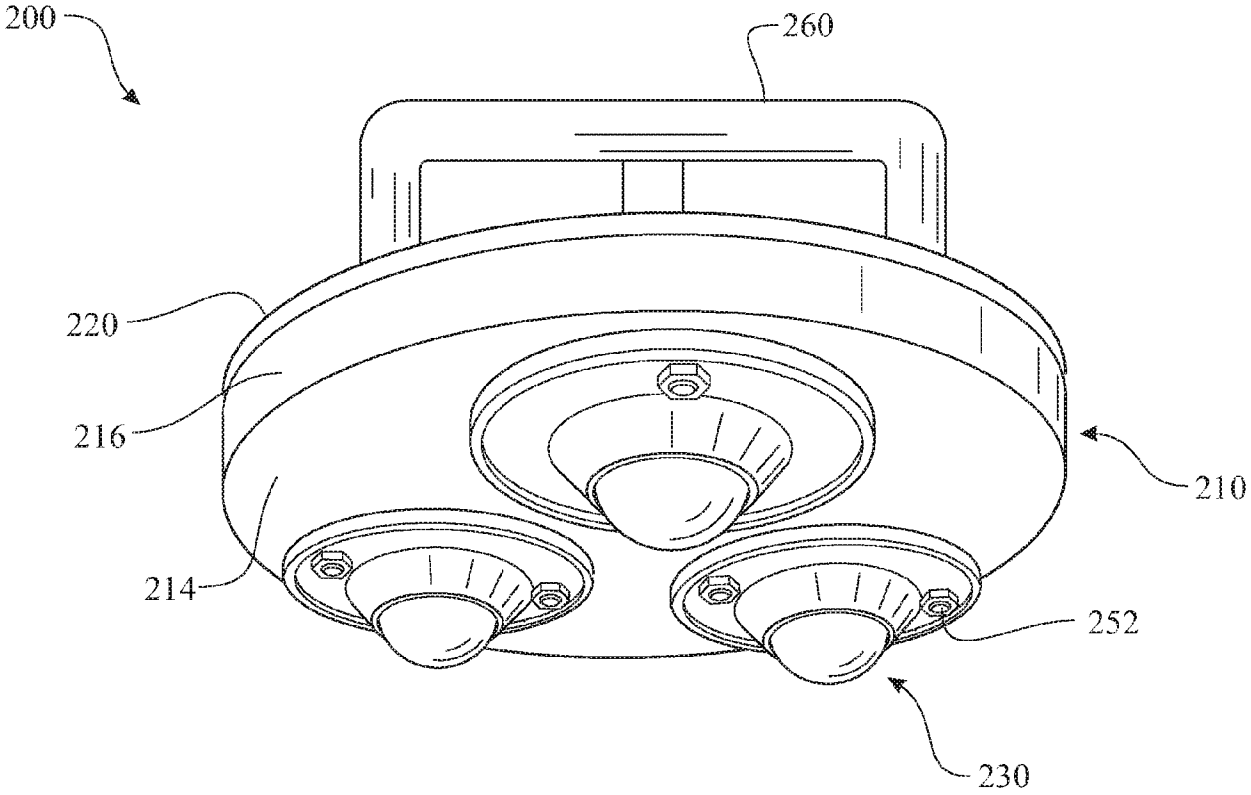
FIG. 5 presents an isometric view of an alternate exemplary embodiment of an omnidirectional exercise platform, wherein the alternative embodiment further includes a detachable handle.
Figure 6:
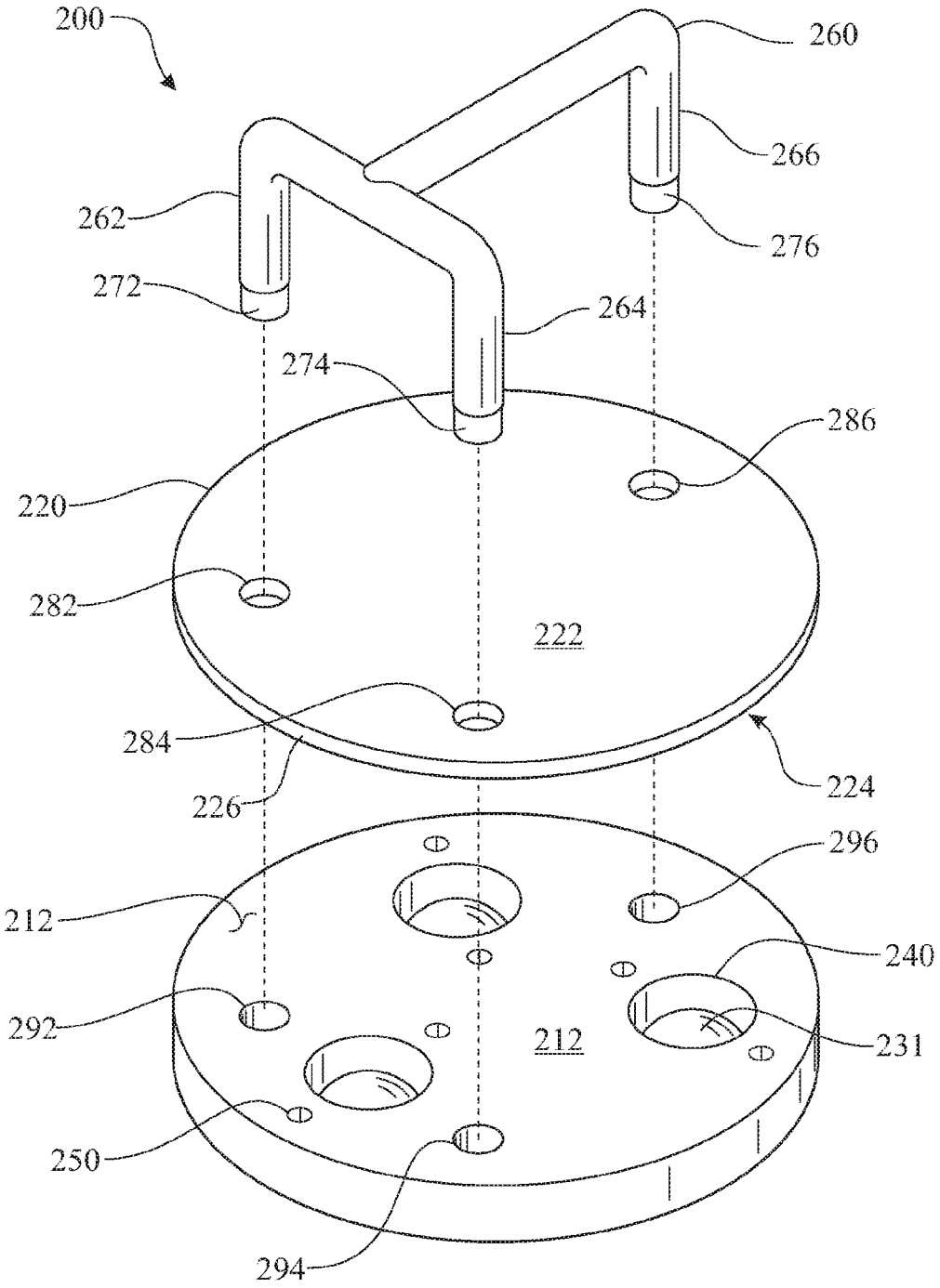
FIG. 6 presents an isometric exploded assembly view of the exemplary alternate embodiment of FIG. 5.

An alternative embodiment of the omnidirectional exercise platform 100 is identified as an omnidirectional exercise platform 200, which is illustrated in FIGS. 5 and 6. The omnidirectional exercise platform 100 and the omnidirectional exercise platform 200 comprises a number of like elements, wherein like features are numbered the same except preceded by the numeral '2'.

Figure 7:
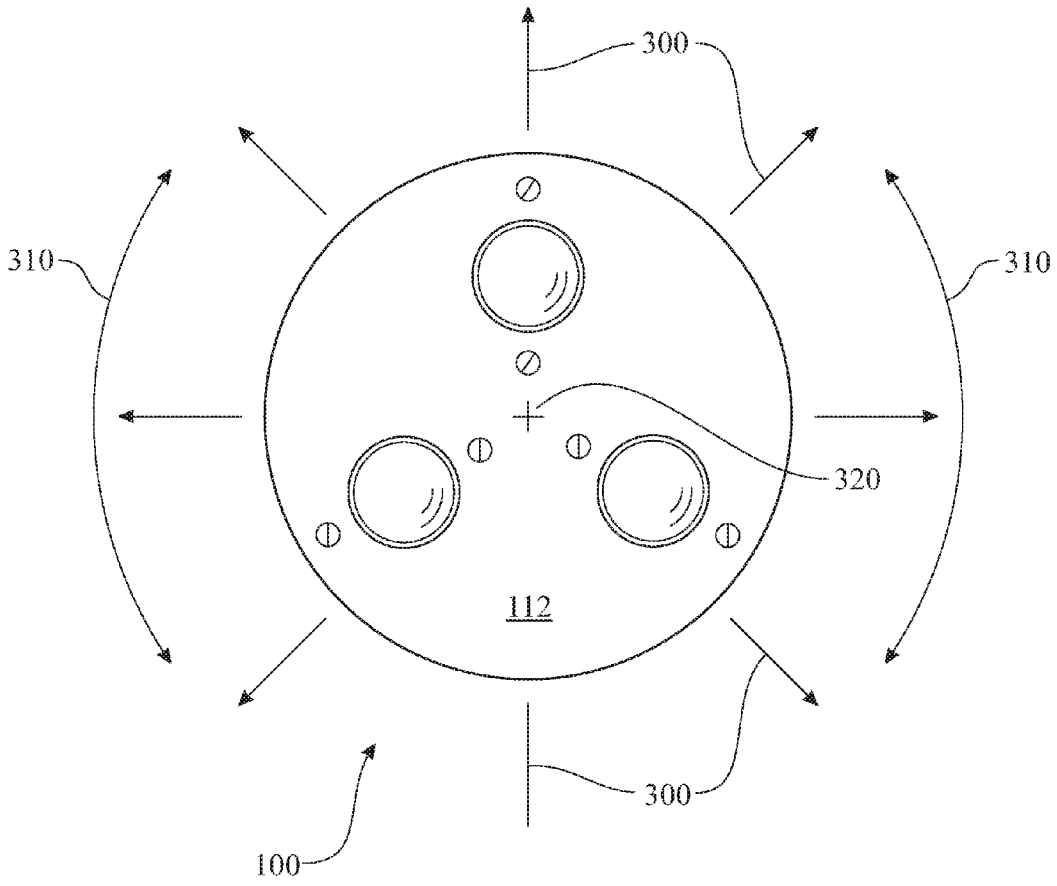
FIG. 7 presents a bottom view of the exemplary embodiment originally introduced in FIG. 1 introducing omnidirectional motion lines.

The omnidirectional exercise platform 200 introduces a T-shaped handle 260 having three short vertical columns or bollards 262, 264, 266 that extend downward from a generally horizontal element of the handle 260. In the exemplary embodiment, the handle 260 is configured for releasable coupling with omnidirectional exercise platform 200. A distal end 272, 274, 276 of each bollard 262, 264, 266 passes through a respective bollard passage aperture 282, 284, 286 formed through the pad member 220. Each distal end 272, 274, 276 of each bollard 262, 264, 266, respectively, is press fit into a respective cavity 292, 294, 296 formed into the top surface 212 of the base member 210. In this embodiment, the handle 260 provides a user 400 (FIG. 8), of the omnidirectional exercise platform 200, with the added feature of being able to employ a closed fist grip while performing a desired exercise. The handle 260 can be fabricated using any of a variety of known manufacturing processes, including: injection molding, casting, machining, metal forming and joining, and the like; and any suitable material, including: metal alloys, plastics, resins, and the like that one of ordinary skill in the art would readily appreciate. In another variation, each distal end 272, 274, 276 of each bollard 262, 264, 266 can be releasably coupled to the base member 210 by being inserted within a respective cavity 292, 294, 296 and retained therein by any one of a variety of known mechanical coupling elements such as: snap fit, threaded fasteners, quick connect fasteners, retention screws/pins (not show), magnets, and the like. It is understood that the handle 260 can be configured in any other suitable geometric shape such as: an I-shape, an L-shape, a semi-circular shape, and the like. Each of the designs would be suitable for releasably coupling the handle 260 with the omnidirectional exercise platform 200. The bollards 262, 264, 266 provide a dimensional offset or vertical gap between a lower surface of the handle 260 and the top surface 222 of the pad member 220. For example, an I-shaped handle may be employed by reducing the number of bollards to two and providing respective apertures and cavities for mating with omnidirectional exercise platform 200. The handle 260 can be enhanced to improve a user's grip and comfort, by configuring the handle 260 with a textured surface, incorporating a pliant gripping surface, such as a neoprene coating, a silicone coating, a rubber coating, and the like In use, the omnidirectional exercise platform 100 provides a user 400 with a device that substantially enhances and activates additional muscle groups during a push-up type of exercise, such as those illustrated in FIG. 8. The top view of omnidirectional exercise platform 100, as shown in FIG. 7, clearly indicates various omnidirectional motion lines in accordance with the present invention. In particular, FIG. 7 illustrates two types of omnidirectional motion lines. The first omnidirectional motion lines are co-planar lines 300 that show exemplary translative motion paths that omnidirectional exercise platform 100 may freely move along during use. The co-planar lines 300 are generally co-planar with a support surface 410 (see FIG. 8), whereby the support surface 410 is preferably a generally horizontally oriented surface that supports the omnidirectional exercise platform 100, 200 during use. The second type of omnidirectional motion lines are rotational lines 310 and illustrate the ability of omnidirectional exercise platform 100, 200 to rotate or twist about a vertically oriented rotational axis 320 that is normal (i.e., perpendicular) to the support surface 410 and passes through the rotational center of omnidirectional exercise platform 100, 200.

During the execution of a physical exercise such as a push-up, illustrated in FIG. 8, the hands of a user 400 are placed on the pad member top surface 122 of omnidirectional exercise platform 100 while the user 400 is in a prone position (not shown). As the user 400 begins the push-up exercise, the user 400 contracts various primary muscle groups to raise the body of the user 400 away from the support surface 410 and from a prone position into an end position as shown in FIG. 8. While the user 400 is performing the push-up, each omnidirectional exercise platform 100 of the pair of omnidirectional exercise platforms 100 is free to translate along the support surface 410 and also rotate about the vertically oriented rotational axis 320. In response to the translation/rotation of omnidirectional exercise platform 100, the user 400 must activate various secondary muscle groups to maintain the initial position of omnidirectional exercise platform 100. Alternatively, the user 400 may intentionally desire a translation/rotation movement of omnidirectional exercise platform 100 to enhance the push-up exercise and thereby engage additional primary and secondary muscle groups to effectuate such movement.

Figure 9:
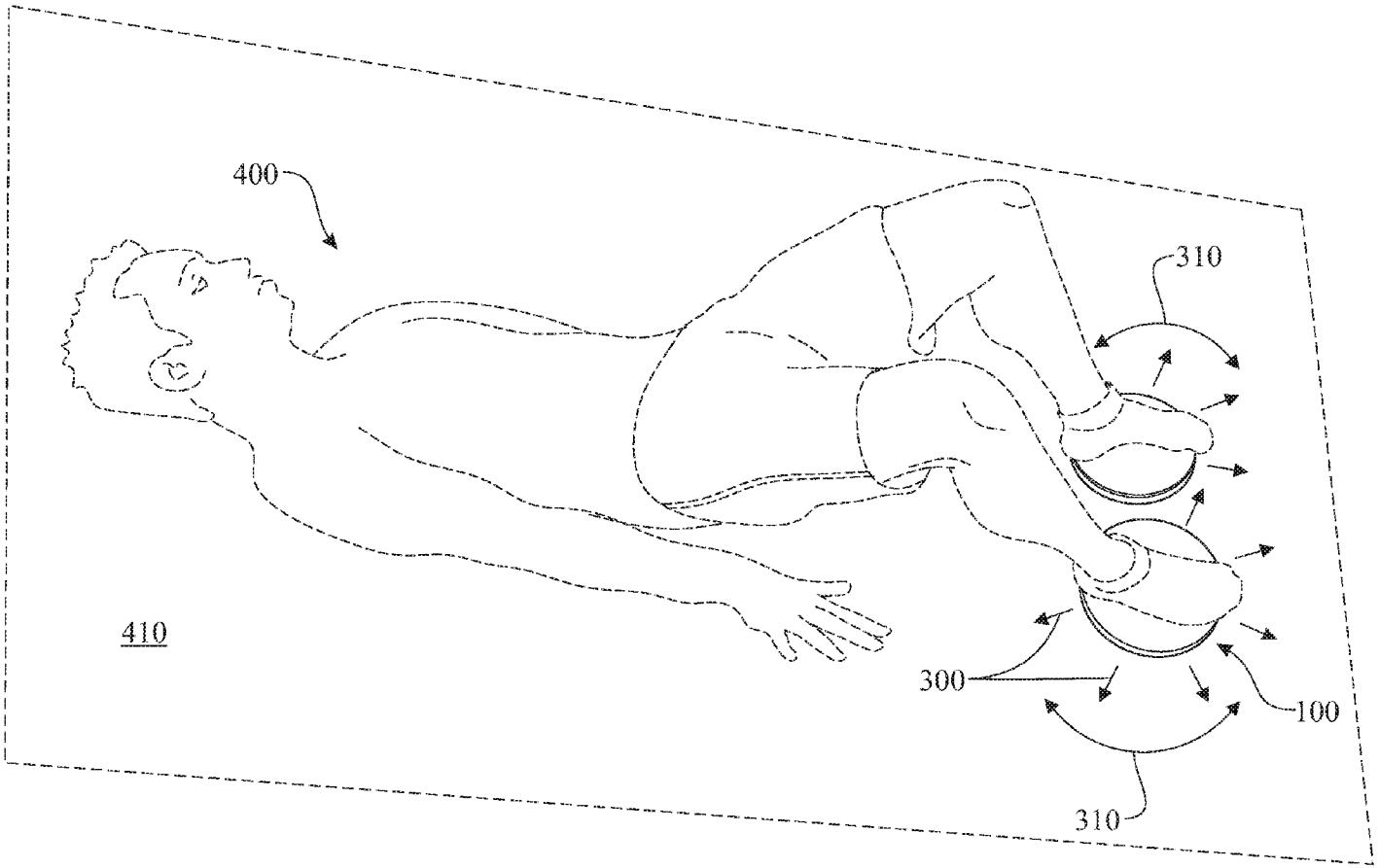
FIG. 9 presents a perspective view of the exemplary embodiment originally introduced in FIG. 1, wherein the omnidirectional exercise platform is shown in use during a hamstring raise exercise.
Figure 10:
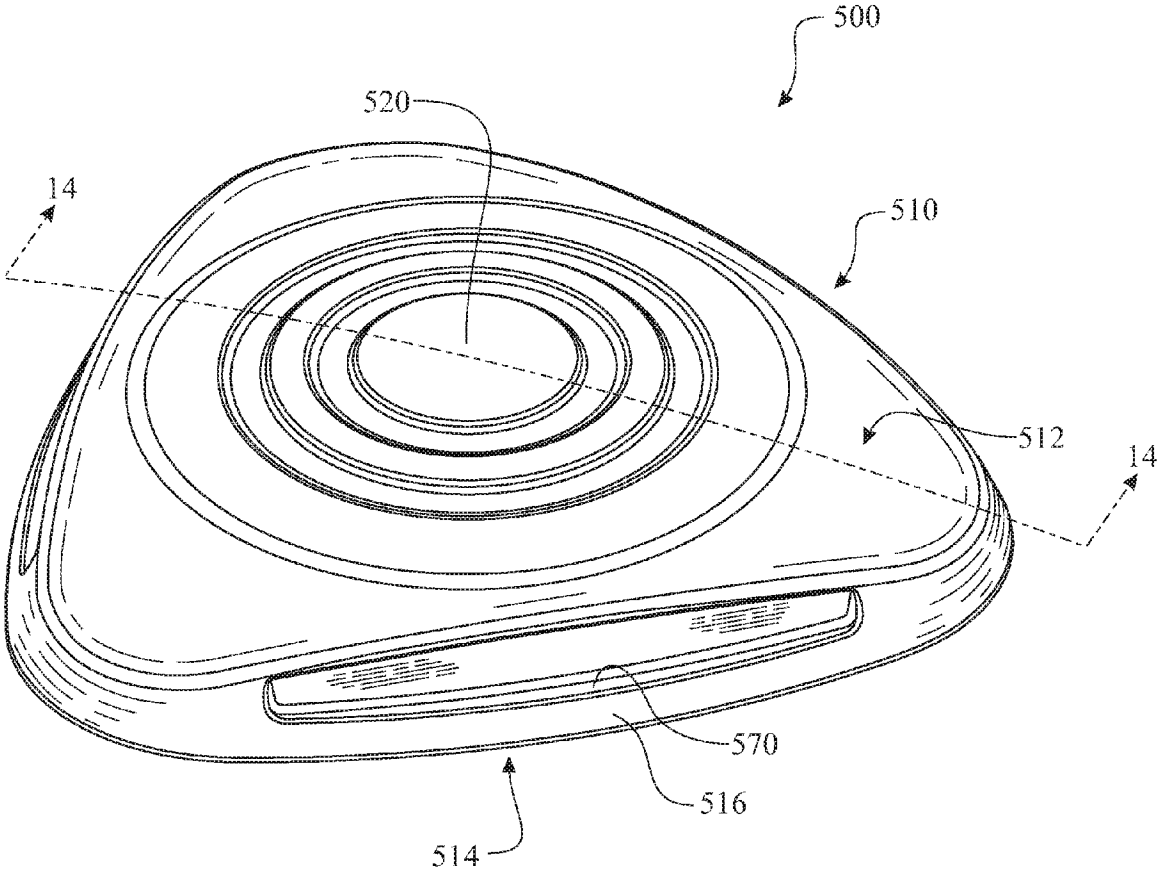
FIG. 10 presents an isometric top view of an exemplary embodiment of a triangular shaped omnidirectional exercise platform.
Figure 11:
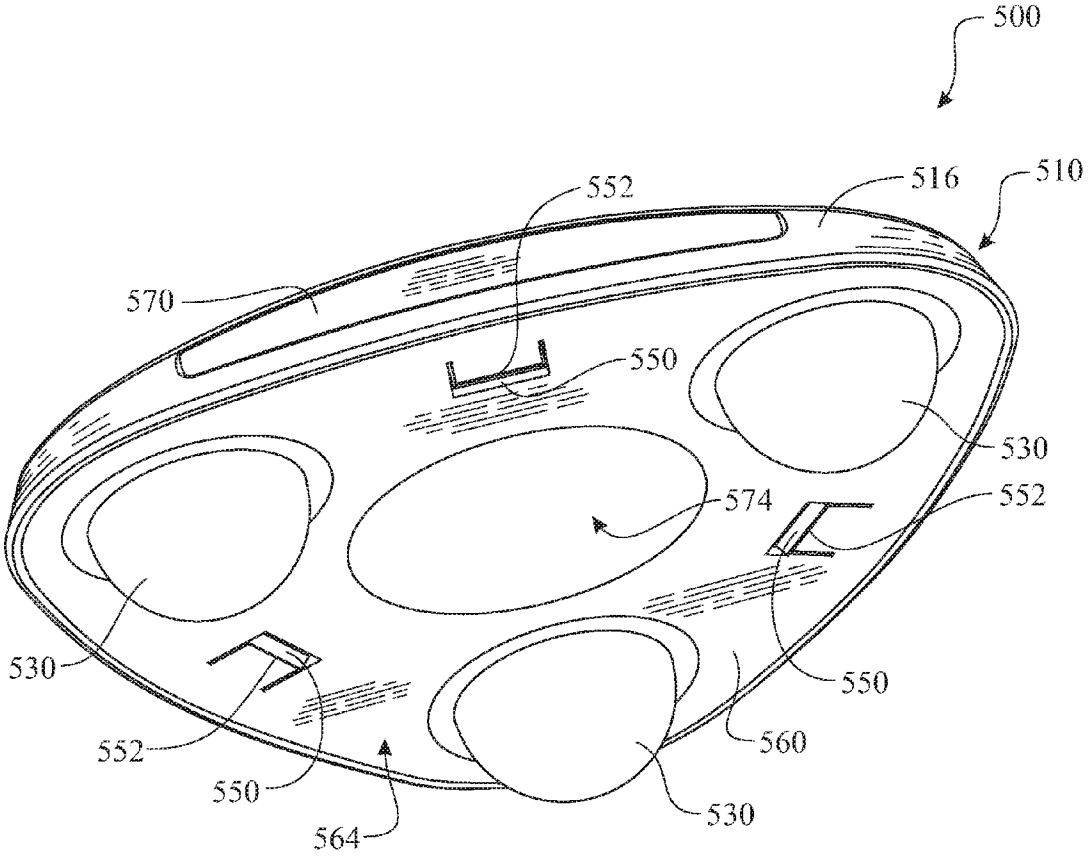
FIG. 11 presents an isometric bottom view of the triangular shaped omnidirectional exercise platform introduced in FIG. 10.
Figure 12:
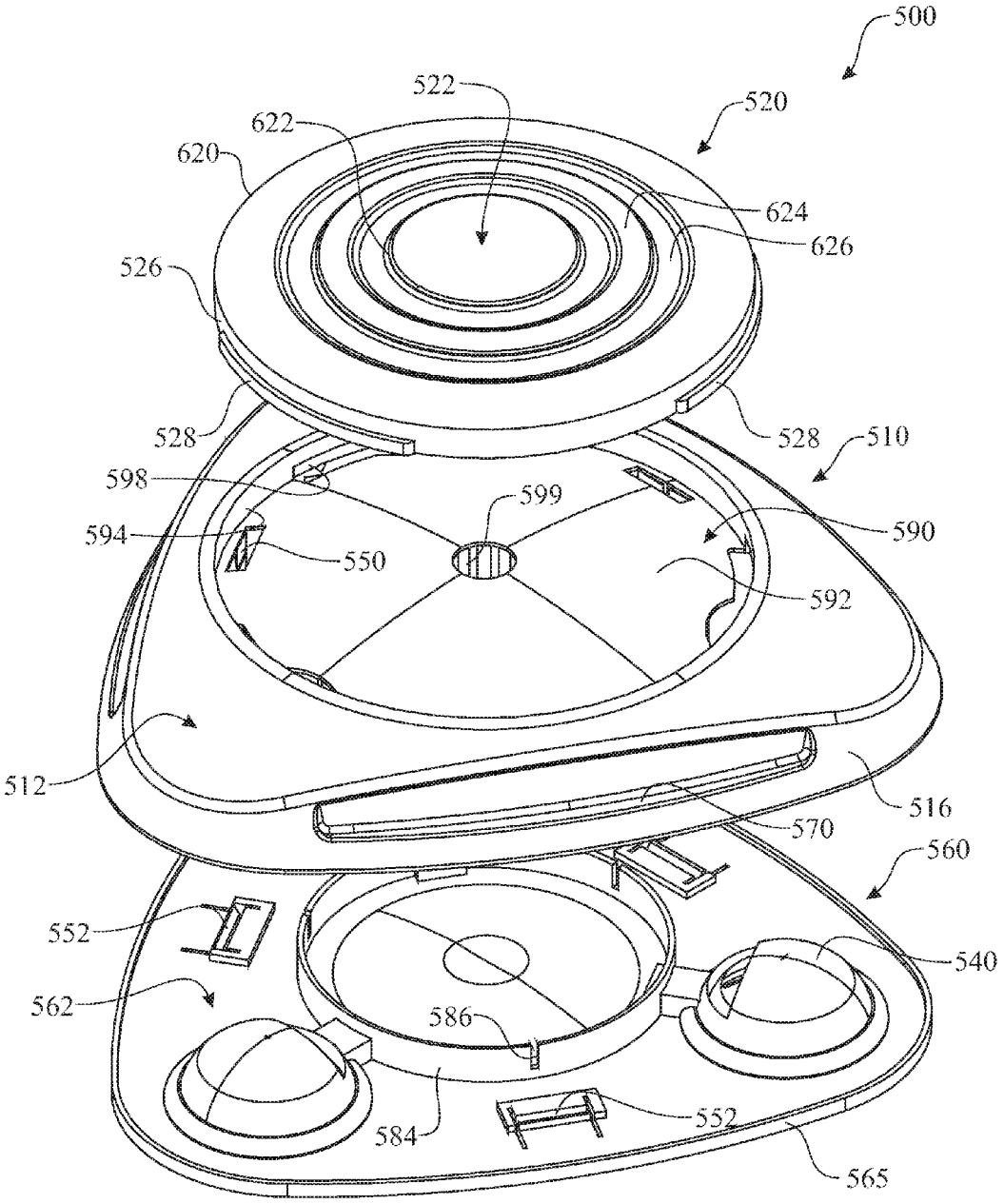
FIG. 12 presents an isometric top exploded assembly view of the triangular shaped omnidirectional exercise platform introduced in FIG. 10.
Figure 13:
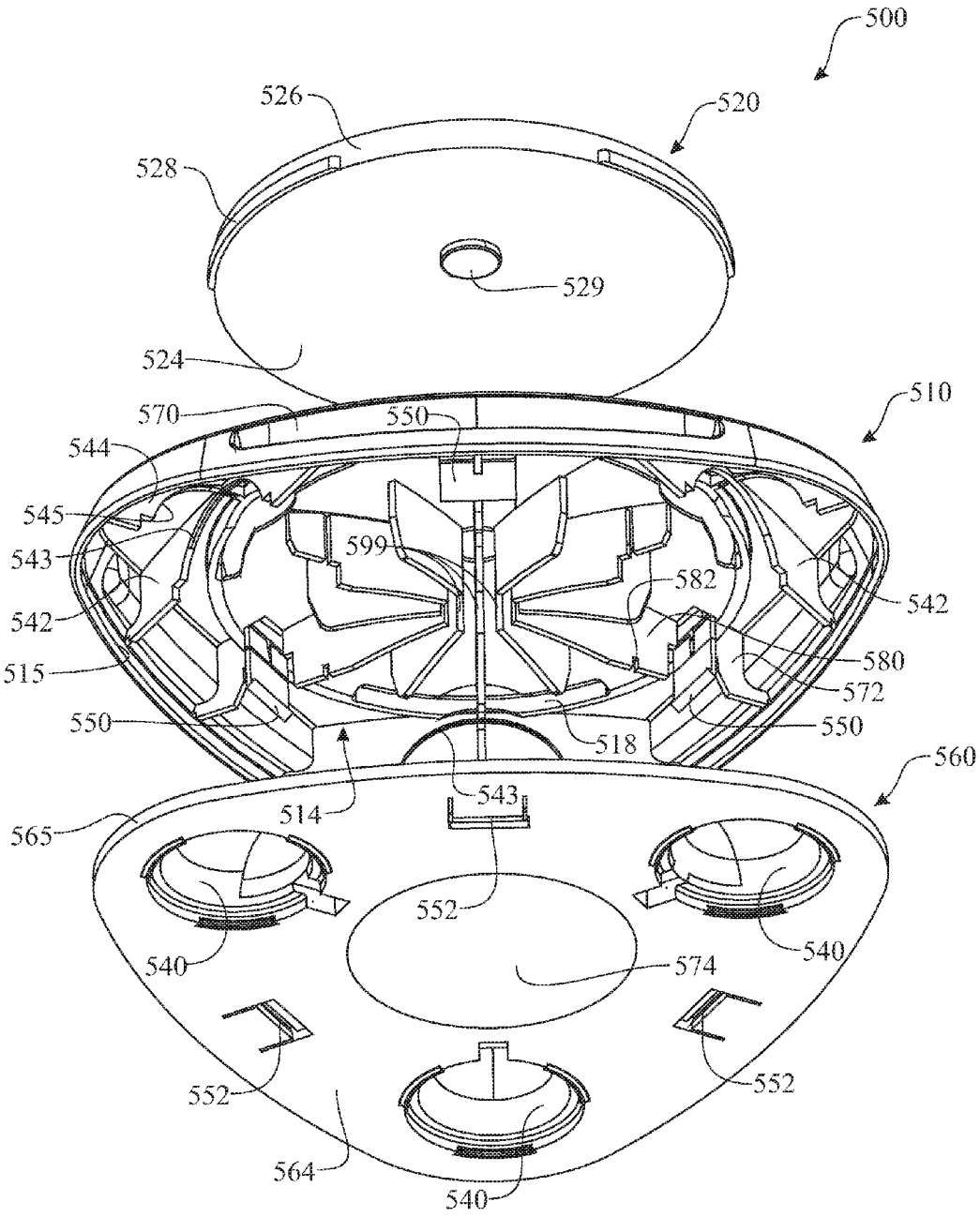
FIG. 13 presents an isometric bottom exploded assembly view of the triangular shaped omnidirectional exercise platform introduced in FIG. 10.

Another exemplary physical exercise that can be performed using the omnidirectional exercise platform 100 in accordance with the present invention, as illustrated in FIG. 9. This exercise is commonly referred to as a hamstring raise. Generally, a hamstring raise is accomplished by activating primary muscle groups of the legs and back by raising a body of user 400 from an initial position resting upon the support surface 410 to a raised position above the support surface 410. During a hamstring raise, feet of a user 400 are placed onto pad member top surfaces 122 of the omnidirectional exercise platforms 100. Similar to the push-up, described above, the user 400 contracts various primary muscle groups to raise the body of the user 400 away from a support surface 410 and from the initial position (not shown) into a raised position elevated above the support surface 410, as shown in FIG. 9. While the user 400 is performing the hamstring raise, each omnidirectional exercise platform 100 of the pair of omnidirectional exercise platforms 100 is free to translate along support surface 410 and also rotate about the vertically oriented rotational axis 320 (shown in FIG. 8). In response to the translation/rotation of each omnidirectional exercise platform 100 of the pair of omnidirectional exercise platforms 100, the user 400 must activate various secondary muscle groups to maintain the initial position of omnidirectional exercise platforms 100. Alternatively, user 400 may intentionally desire a translation/rotation movement of one or both omnidirectional exercise platforms 100 of the pair of omnidirectional exercise platforms 100 to enhance the hamstring raise exercise and thereby engage additional primary and secondary muscle groups.

Figure 14:
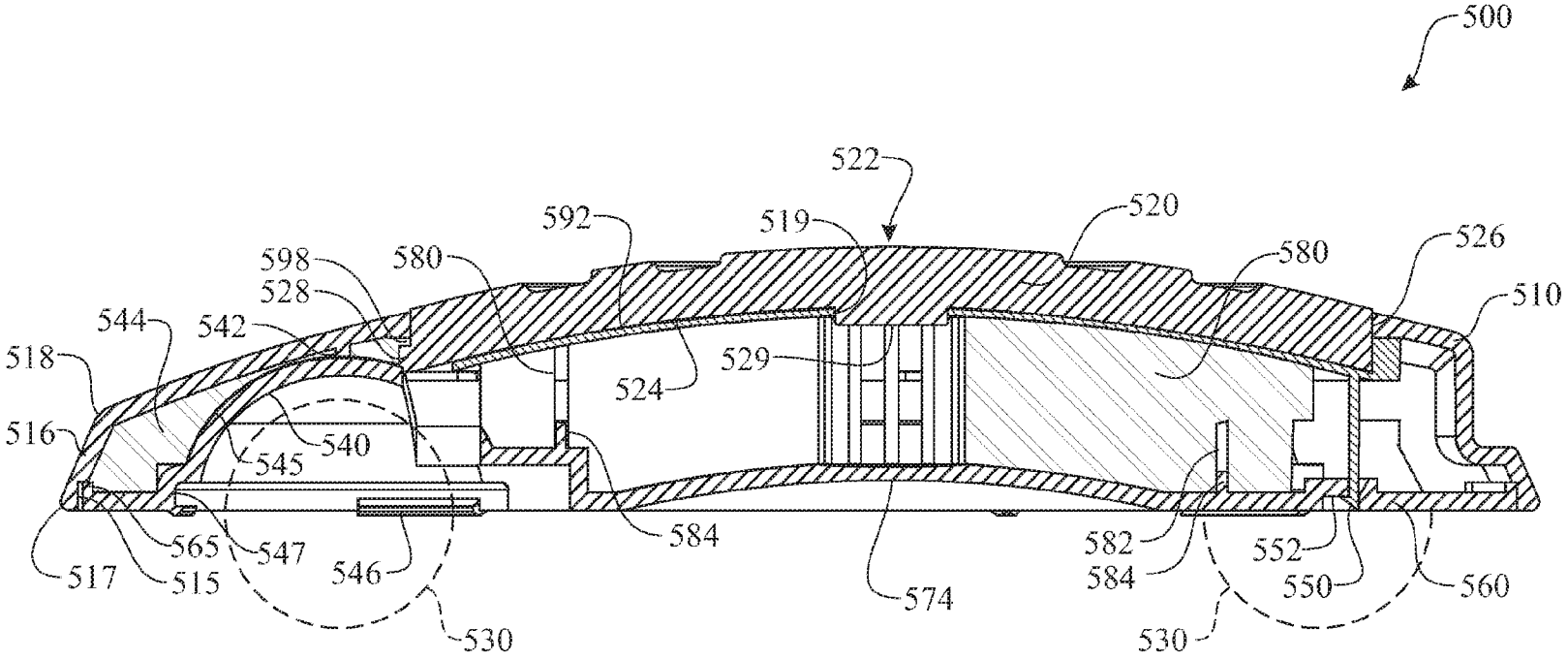
FIG. 14 presents a sectioned elevation view of the triangular shaped omnidirectional exercise platform introduced in FIG. 10, the section taken along section line 13--13 of FIG. 10.
Figure 15:
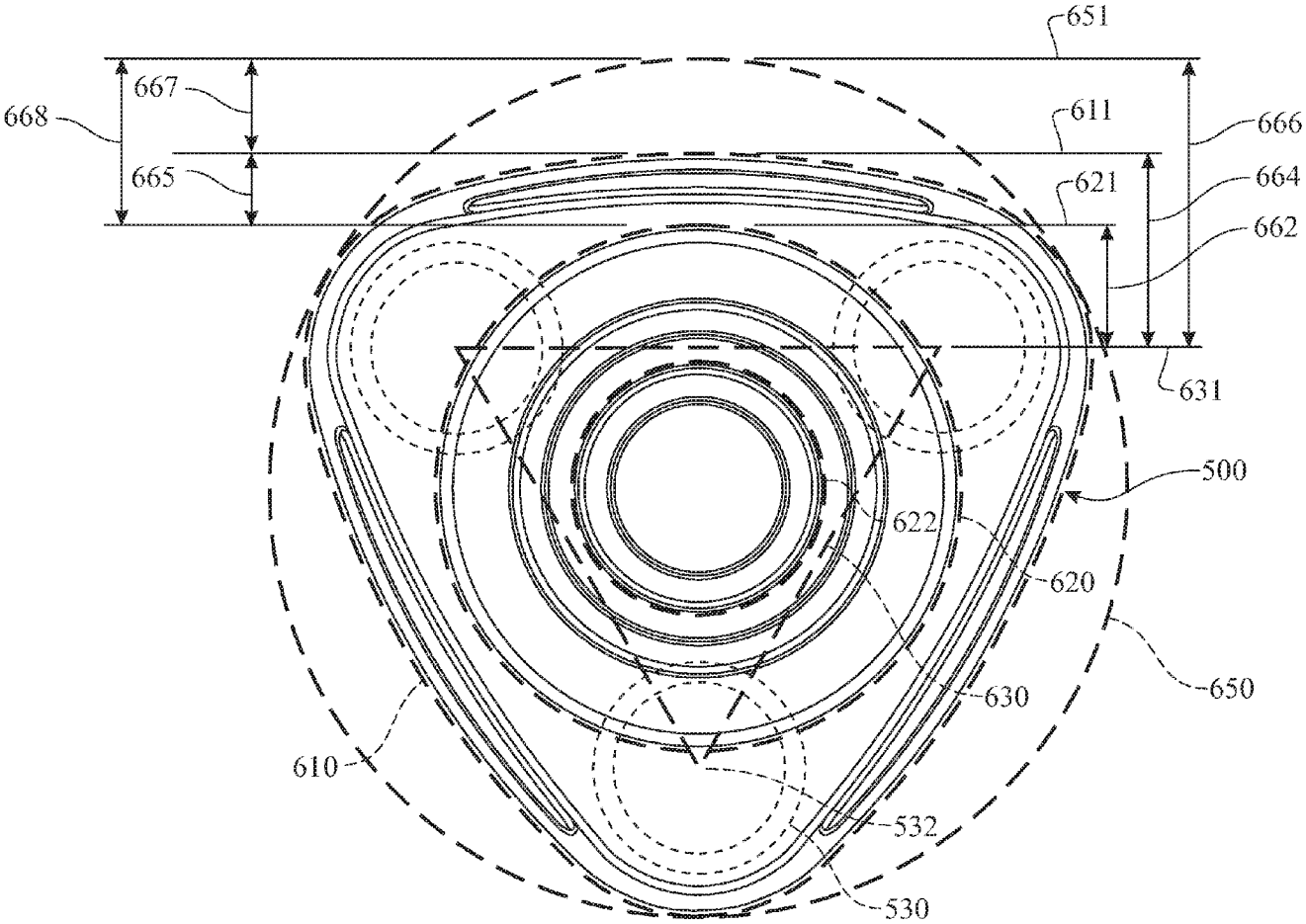
FIG. 15 presents a top plan view of the triangular shaped omnidirectional exercise platform introduced in FIG. 10, introducing geometric distinctions over platforms of other shapes.
Figure 16:
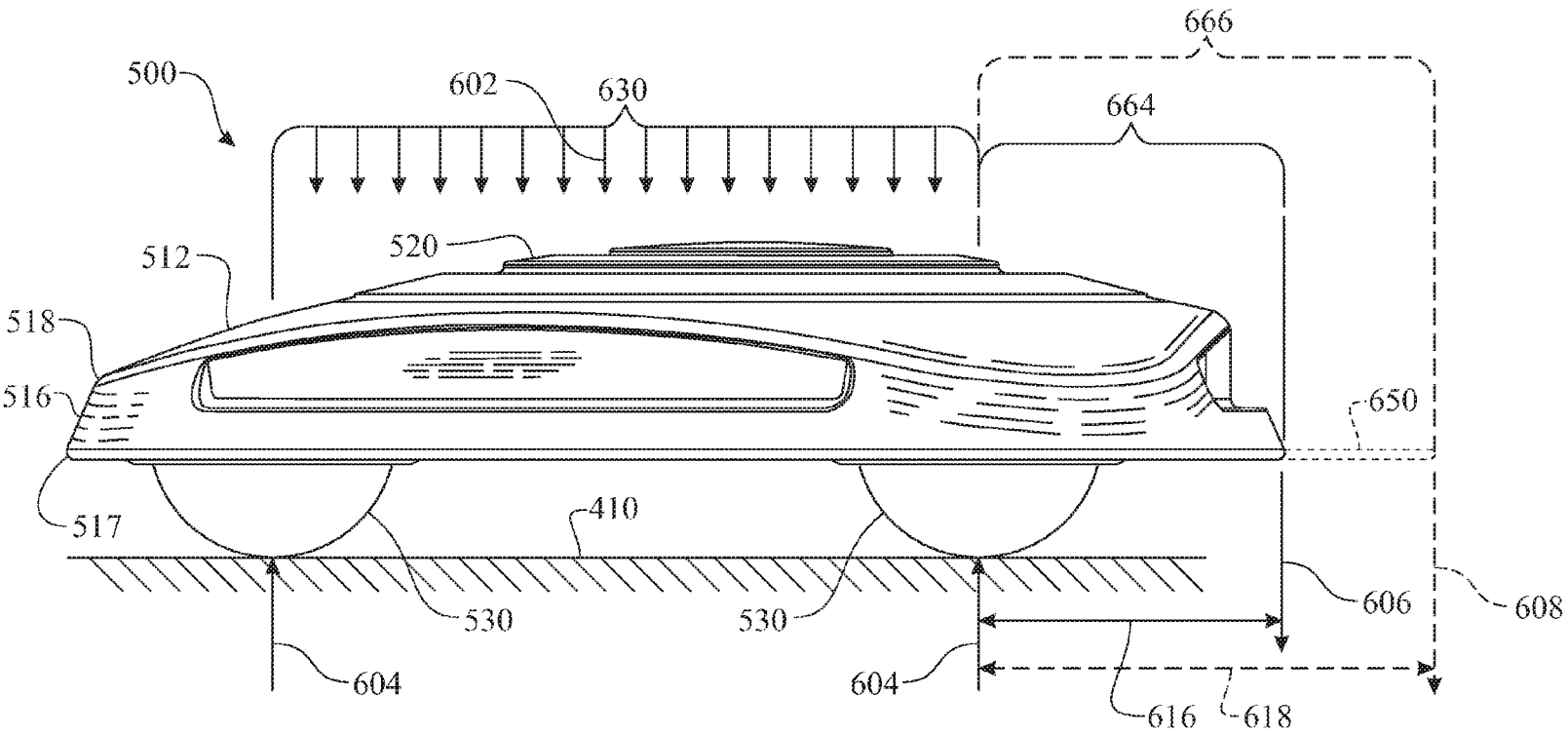
FIG. 16 presents a side elevation view of the triangular shaped omnidirectional exercise platform introduced in FIG. 10, introducing differences in physics compared to platforms of other shapes.

An exemplary triangular shaped omnidirectional exercise platform 500 is introduced and detailed in FIGS. 10 through 14, with the characteristic benefits being detailed in FIGS. 15 and 16. The triangular shaped omnidirectional exercise platform 500 includes three ball transfer unit 530 equally spaced (radially and angular) about a center of a triangular shaped base 510, 560. The triangular shaped base 510, 560 can be assembled having one or multiple components. In the exemplary embodiment, the triangular shaped base is a two piece assembly, including an upper body member 510 and a lower body member 560. An orientation of the upper body member 510 is referenced by an upper body member top surface 512 and an upper body member underside 514. Similarly, an orientation of the lower body member 560 is referenced by a lower body member topside surface 562 and a lower body member bottom surface 564. The upper body member 510 is assembled by joining the upper body member underside 514 and the lower body member bottom surface 564 with one another.

The upper body member 510 and lower body member 560 can be assembled to one another using any suitable assembled techniques, including mechanical fasteners, such as snaps, threaded fasteners, quick lock or twist lock fasteners, dense hook and loop tape, and the like; bonding agents, such as adhesive, epoxy, and the like; welding, such as ultrasonic welding, spot welding, and the like; any combination thereof, or any other suitable assembly technique. An alignment feature can be included in the upper body member 510 and/or lower body member 560 to align and preferably seal the upper body member 510 and lower body member 560 with one another. In the exemplary embodiment, a lower body member receiving rabbet 515 is formed about an interior edge of the upper body member sidewall 516. Matingly, a lower body assembly ridge 565 is formed about a peripheral edge of the lower body member 560. When assembled, the lower body assembly ridge 565 is inserted into the lower body member receiving rabbet 515. The lower body member receiving rabbet 515 and lower body assembly ridge 565 can be design having a simple sliding interface, a snap interface, or any other suitable interface/coupling design. A pad member 520 can be removably assembled to an upper region of the upper body member 510. In the exemplary embodiment, the upper body member 510 is assembled to the lower body member 560 using a plurality of spatially arranged assembly snap hooks 550 and respective hook latch apertures 552. Each assembly snap hook 550 includes a hook formed at a distal end of a cantilevered tab. Each hook latch aperture 552 is sized enabling the hook end of the assembly snap hook 550 to pass therethrough. The hook latch aperture 552 is offset, where the hook engages with a lip formed along one edge of thereof and is retained in position by a natural spring force created by the geometry of the latching hook and lip assembly and the selected material used to manufacture the upper body member 510. The lower body member receiving rabbet 515 and lower body assembly ridge 565 can be symmetric enabling any of three orientations or the lower body member receiving rabbet 515 and lower body assembly ridge 565 can be keyed, limiting the assembly to a single orientation.

The upper surface of the triangular shaped omnidirectional exercise platform 500 is designed to be gripped by the user, similar to the manners presented in the various applications previously described in FIGS. 8 and 9. The upper surface can include various features for aiding the user in properly and adequately gripping the triangular shaped omnidirectional exercise platform 500. The upper surface can additionally include features or components to enhance user comfort during use. The upper surface can include features to aid the user in properly locating their appendage to optimize use of the triangular shaped omnidirectional exercise platform 500.

A pad member 520 is integrated into the triangular shaped omnidirectional exercise platform 500 in the exemplary embodiment to provide user guidance, support, and comfort. The pad member 520 can be manufactured of a pliant material, such as foam, silicone, pliant plastic, rubber, and the like. The pad member 520 can be considered a wear item and is therefore, preferably removably assembled to the upper body member 510. The pad member 520 is preferably formed as a circular disc having a pad member top surface 522, as pad member bottom surface 524, and a pad member sidewall 526 defining and circumscribing a peripheral edge extending between the pad member top surface 522 and the pad member bottom surface 524. The pad member 520 can include a plurality of pad member retention features 528, each pad member retention feature 528 being located along a circumferential portion of the pad member sidewall 526 proximate the pad member bottom surface 524. The pad member 520 can include two (2), three (3) or more pad member retention features 528. The pad member retention feature 528 can be equally sized and spaced enabling assembly of the pad member 520 to the upper body member 510 in any of multiple orientations. Alternatively, the pad member retention features 528 can be unequally spaced, having varied thicknesses, have varied lengths, or include any other unique feature to key the orientation when assembling the pad member 520 to the upper body member 510. A stabilizing feature, such as a pad member central registration protrusion 529, can be included in the pad member bottom surface 524, wherein the pad member central registration protrusion 529 (FIG. 13) provides increased stability to the pad member 520.

In the exemplary embodiment, the pad member 520 is inserted into an upper base member pad receiving cavity 590 formed extending inward into the upper body member 510 from an upper body member top surface 512. The upper base member pad receiving cavity 590 includes a pad receiving cavity sidewall 594 extending downward from the upper body member top surface 512 defining a peripheral edge of the upper base member pad receiving cavity 590 and a pad receiving cavity base 592 defining a bottom surface of the upper base member pad receiving cavity 590. The pad receiving cavity base 592 can be convex (as shown), planar, or concave. The pad receiving cavity base 592 would preferably be shaped to mimic and mate with the shape of the pad member bottom surface 524. A plurality of pad member retention rabbets 598 is formed within the upper base member pad receiving cavity 590 of the upper body member 510, wherein each pad member retention rabbet 598 is sized and shaped for receiving and retaining a respective pad member retention feature 528. The pad member retention rabbet 598 can be designed as a slot undercutting into the interior of the upper body member 510 as shown in FIG. 14. The pliancy of the material of the pad member 520 enables the user to compress the pad member 520, enabling each pad member retention feature 528 to pass into the upper base member pad receiving cavity 590, slide down the pad receiving cavity sidewall 594 and seat into the pad member retention rabbet 598. Each pad member retention rabbet 598 can include an access feature, enabling a user to insert their finger through the access feature and ensure the pad member retention feature 528 is properly seated into the pad member retention rabbet 598. A pad member central registration receptacle 599 can be formed through the upper body member top surface 512 and into features within an interior of the upper body member 510 for receiving and retaining the pad member central registration protrusion 529 in position. The retention of the pad member central registration protrusion 529 accommodates for any stretch or other motion of the material of the pad member 520, effectively reducing a stretch dimension by half (or more if multiple pad member central registration protrusions 529 are designed into the triangular shaped omnidirectional exercise platform 500).

Three ball transfer unit receiving sockets 540 are formed extending inward from a lower body member bottom surface 564 of the lower body member 560. Each ball transfer unit receiving socket 540 is located proximate one of the three corners of the triangular shaped base 510, 560. Each ball transfer unit receiving socket 540 is formed extending inward from the lower body member bottom surface 564. The lower body member 560 can include one or more assembly features for securing a ball transfer unit 530 within the ball transfer unit receiving socket 540. It is understood that the assembly features can be of any suitable form factor known by those skilled in the art. The exemplary embodiment employs a series of ball transfer unit assembly receiving tabs 546 and an associated ball transfer unit assembly receiving slot 547, wherein the ball transfer unit assembly receiving tab 546 retains a mounting feature (such as the mounting feature 136 (FIGS. 2 & 4)) of the ball transfer unit 530 within the ball transfer unit assembly receiving slot 547. A primary ball member (similar to the primary ball member 133) would extend downward below the lower body member bottom surface 564. A portion of the primary ball member would be recessed within the ball transfer unit receiving socket 540 to lower a center of gravity of the triangular shaped omnidirectional exercise platform 500. The exemplary embodiment includes three ball transfer unit assembly receiving tabs 546 and associated ball transfer unit assembly receiving slots 547 for each ball transfer unit receiving socket 540. Although the exemplary embodiment utilizes a receiving tab 546 and an associated receiving slot 547, it is understood that the ball transfer unit 530 can be assembled to the lower body member 560 using any suitable assembly configuration, including other mechanical fasteners, threaded fasteners, quick connect or quick twist fasteners, and the like. It is preferred that the assembly configuration enables removal and reassembly of the ball transfer unit 530 to the lower body member 560. The removal and reassembly of the ball transfer unit 530 to the lower body member 560 enables servicing, repairs, maintenance, etc. of the ball transfer unit 530 and the ball transfer unit receiving socket 540.

The upper body member 510 includes a domed upper body member top surface 512 and an upper body member sidewall 516 extending downward from a peripheral edge of the upper body member top surface 512. The upper body member top surface 512 has a triangular shape comprising three slightly outwardly arched sides and rounded corners. The upper body member sidewall 516 can be angled, tapering outward from top to bottom (as shown) or substantially vertical. More specifically, the triangular shaped base member sidewall 516 is formed having triangular frustum shape, wherein a bottom edge 517 of the triangular shaped base member sidewall 516 is longer than an upper edge 518 of the triangular shaped base member sidewall. A sidewall handgrip 570 can optionally be integrated into each of the sidewall portions of the upper body member sidewall 516. Each sidewall handgrip 570 would be a recess, sized for insertion of a user's fingers. Each of the upper body member top surface 512 and upper body member sidewall 516 are preferably fabricated of a panel of plastic or similar material, wherein the panel is of a thickness that provides adequate support. Additional structural rigidity can be provided by introducing an internal support structure. The internal support structure can be provided in any suitable configuration based upon design selection and structural engineering. The exemplary embodiment includes components presented in FIGS. 12 and 13, with the interactions best shown in the section drawing presented in FIG. 14. Centrally, a series of upper base member radial assembly support ribs 580 extend radially outward from the pad member central registration receptacle 599 to a distal end proximate a peripheral edge of the upper base member pad receiving cavity 590 (defined by the pad receiving cavity sidewall 594). The inner edge of one or more upper base member radial assembly support rib 580 can be included to aid in forming at least a portion of the pad member central registration receptacle 599.

A similar structure of one or more supporting elements can be included in the design of the lower body member 560. In the exemplary embodiment, the lower base member assembly support ridge 584 is provided as a vertical wall having a circular shape, extending upward from an interior surface of the lower body member 560. Each upper base member radial assembly support rib 580 would be designed to extend from an inner surface of the upper body member top surface 512 to an inner opposite facing surface of the lower body member 560. At least a portion of the series of upper base member radial assembly support ribs 580 is designed to interlock with the lower base member assembly support ridge 584. The interlocking design increases the structural integrity of the triangular shaped omnidirectional exercise platform 500. The interlocking design can be provided by forming an upper base member radial assembly support slot 582 into one or more of the upper base member radial assembly support ribs 580 and a lower base member assembly support ridge slot 586 formed within a lower base member assembly support ridge 584 of the lower body member 560. The upper base member radial assembly support slot 582 and the lower base member assembly support ridge slot 586 would be located, sized, and shaped to mate with one another when the upper body member 510 and the lower body member 560 are assembled to one another. The interlocking design ensures that the upper base member radial assembly support ribs 580 remain upright and avoid failure by restricting a bottom edge of the upper base member radial assembly support rib 580 from sliding sideways.

Similar infrastructure is included to provide adequate support to each ball transfer unit receiving socket 540. A transverse socket supporting rib 542 extends downward from the interior surface of the upper body member top surface 512 proximate each ball transfer unit receiving socket 540. A transverse socket supporting surface 543 is formed in each transverse socket supporting rib 542, wherein the transverse socket supporting surface 543 is shaped, sized, and located to contact an interior surface of the ball transfer unit receiving socket 540. Each transverse socket supporting rib 542 is oriented perpendicular to a radial line from a center of the upper body member 510. Similarly, a radial socket supporting rib 544 extends downward from the interior surface of the upper body member top surface 512 proximate each ball transfer unit receiving socket 540, but along the radial line. A radial socket supporting surface 545 is formed in each radial socket supporting rib 544, wherein the radial socket supporting surface 545 is shaped, sized, and located to contact the interior surface of the ball transfer unit receiving socket 540.

The supporting ribs can additionally include one or more handgrip supporting ribs 572 for supporting the sidewall handgrip 570. It is understood that the supporting infrastructure can be designed in any suitable configuration to adequately support an individual while they are exercising using the triangular shaped omnidirectional exercise platform 500, while minimizing an overall weight of the triangular shaped omnidirectional exercise platform 500.

A concave bottom surface 574 can be formed extending from the lower body member bottom surface 564 of the lower body member 560. The concave bottom surface 574 provides several functions. The concave bottom surface 574 provides an additional rigidity to the lower body member 560. The concave bottom surface 574 provides an additional height clearance from the lower body member bottom surface 564 in a region between each of the three ball transfer units 530. The height clearance accommodates uneven surfaces.

The triangular shape of the omnidirectional exercise platform 500 provides a number of unique benefits. A device with three (3) ball transfer units 530 ensures stability when placed upon a support surface 410. Three (3) contact points 532 define a plane. The three contact points 532 would provide stability on a planar surface or an uneven surface. A device with less than three (3) ball transfer units 530 would fail to provide adequate planar stability. A device with more than three (3) ball transfer units 530 would introduce a potential of a rocking on a supporting surface 410 that is planar and more so on a supporting surface 410 that is not planar. The triangular shape of the omnidirectional exercise platform 500 locates each of the ball transfer units 530 proximate a corner of the body 510, 560.

The triangular shaped omnidirectional exercise platform 500 includes a series of features to ensure stability during use, as illustrated in FIGS. 15 and 16. The initial feature is the triangular shape of the body 510, 560. The primary ball member centroid 532 of each of the three (3) ball transfer unit 530 defines a ball member defined stability binding region 630. Applying physics, if a downward force is applied to the triangular shaped omnidirectional exercise platform 500 within the ball member defined stability binding region 630, it would be impossible to cause the triangular shaped omnidirectional exercise platform 500 to tilt upward. The triangular shape minimizes a dimension (platform body instability margin 664) spanning between the ball member stability binding region tangential edge 631 and the triangular platform distal edge 611. The platform body instability margin 664 includes the downward sloping edge of the triangular platform peripheral boundary 610. When this is considered, the actual dimension is less than the platform body instability margin 664. The next logical outermost point of contact would be the platform pad member peripheral boundary 620 of the pad member 520. The instability region would then be a dimension (platform pad instability margin 662) extending between the ball member stability binding region tangential edge 631 and the platform pad member tangential edge 621. Because this dimension is small, it is unlikely that the entire force applied by the exercising individual would be applied outside of the ball member defined stability binding region 630. Although any forces applied in this region are outside of the ball member defined stability binding region 630, the triangular shaped omnidirectional exercise platform 500 would remain stable, as the applied torque is based upon a normal force multiplied by a distance. The distance is extremely short, thus minimizing the rotational torque to pivot the triangular shaped omnidirectional exercise platform 500 from a horizontally supported orientation. The optimal use of the triangular shaped omnidirectional exercise platform 500 would locate the user's appendage upon the platform pad member peripheral boundary 620 and preferably located having at least a portion of the supporting force placed within the interior stability indicator 622. The interior stability indicator 622 would be identified as a feature within the platform pad member peripheral boundary 620. It is noted that the pad member 520 includes strategically included features ensuring stability. A first feature is that the diameter of the platform pad member peripheral boundary 620 locates a tangential edge of the platform pad member peripheral boundary 620 within an interior side of each primary ball member centroid 532. In other words, the radius of the pad member 520 is less than a radial distance between a center of the body 510, 560 and each primary ball member centroid 532. The platform pad member peripheral boundary 620 can be identified by any suitable feature. One exemplary design for the platform pad member peripheral boundary 620 would be one or more raised rings 624 and/or one or more recessed rings 626. It is understood that the pad member 520 can include a series of raised rings 624 and/or recessed rings 626 to also provide a gripping area for the user.

A second feature is the ball member defined stability binding region 630, wherein the ball member defined stability binding region 630 is located entirely within the confines of the ball member defined stability binding region 630.

Conversely, an outline of a circular platform 100 is referenced by a circular platform outline 650. The circular platform outline 650 defines a circular platform tangential edge 651. A circular platform instability margin 666 is a distance between the ball member stability binding region tangential edge 631 and the circular platform tangential edge 651. It is noted that the circular platform instability margin 666 is significantly greater than the platform pad instability margin 662. Since it is assumed that the downward force would be the same force, simply applied in a more distal location, the additional distance increases the generated torque, thus increasing the potential for inducing instability to the omnidirectional exercise platform 100. A circular platform extension effective dimension 668 provides another reference dimension, wherein the circular platform extension effective dimension 668 is a dimension extending between the platform pad member tangential edge 621 and the circular platform tangential edge 651.

In an alternative vantage point, the platform defined pad frame segment 665 is unlikely to be subjected to a downward force by the user, as the upper body member sidewall 516 is slanted. The omnidirectional exercise platform 100 introduces a circular platform extension actual dimension 667, or more likely, a circular platform extension effective dimension 668, which significantly increases the likelihood of flipping the omnidirectional exercise platform 100 compared to the triangular shaped omnidirectional exercise platform 500.

Forces associated with the stability are presented in FIG. 16. The optimal downward force (central downward force 602) applied by the user would span between the ball member defined stability binding region 630 defined by each primary ball member centroid 532 of each respective ball transfer unit 530. The downward force is opposed by an upward platform supporting force 604 provided by the support surface 410 through each ball transfer unit 530. In a worst case on the triangular shaped omnidirectional exercise platform 500, the downward force (distal triangular platform downward force 606) could be applied at any location across a platform body instability margin 664. In a worst-case scenario, the distal triangular platform downward force 606 is applied at a distal end of the platform body instability margin 664, introducing a torque generating dimension defined by a triangular platform maximum instability region 616. As mentioned above, the angled shape of the upper body member sidewall 516 and the inclusion of the sidewall handgrip 570 actually reduce the triangular platform maximum instability region 616 when the triangular shaped omnidirectional exercise platform 500 is being used.

Conversely, the omnidirectional exercise platform 100 introduces a wider circular platform instability margin 666. A distal circular platform downward force 608 can be applied at a significantly greater distance (circular platform maximum instability region 618) from the primary ball member centroid 532 compared to the distal triangular platform downward force 606. This significantly increases the likelihood of an instable exercise application.

It is understood that the omnidirectional exercise platform 100, 500 can enable the user to complete any of a variety of additional exercises.

As will be now apparent to those skilled in the art, omnidirectional exercise platform fabricated according to the teachings of the present invention are capable of substantially enhancing one or more physical exercises of a person. Since the present invention provides an omnidirectional exercise platform that permits free multi-directional translation of the platform with respect to a support surface while performing an exercise and correspondingly requires the user to activate secondary muscle groups to prevent undesired movement of the omnidirectional exercise platform. In addition, the invention provides a platform that further permits rotational movement with respect to a vertical axis normal to the support surface. Importantly, the present invention provides a stable platform that reduces the risk of injuring the various joints (e.g., wrists & ankles) of the user. Specifically, with the present invention, it is possible to perform various physical exercises that engage a multitude of secondary muscle groups while simultaneously providing a stable surface that substantially prevents undesired twisting/torquing of delicate joints of the user. Finally, the invention provides a device that may be adapted by a user to employ different handgrip positions during an exercise.

Although the above provides a full and complete disclosure of the preferred embodiments of the invention, various modifications, combinations, alternate constructions and equivalents will occur to those skilled in the art. For example, although the invention has been described with reference to coupling the padded member to the base member, alternatively the padded member may be configured for easy removal to facilitate cleaning/replacement. Further, the invention has been described with reference to using individual ball transfer units that are coupled to the base member, these components may be permanently coupled or integrally formed therewith. It is intended that all matters in the foregoing description and shown in the accompanying drawings be interpreted as illustrative and not in a limiting sense. Therefore the above should not be construed as limiting the invention, which is defined by the appended claims and their legal equivalence.

ELEMENT DESCRIPTION REFERENCES

Ref No. Description

100 omnidirectional exercise platform
110 base member
112 top surface
114 bottom surface
116 sidewall
120 pad member
122 pad member top surface
124 pad member bottom surface
126 pad member sidewall
130 ball transfer unit
131 ball transfer unit housing
132 primary ball retention member
133 primary ball member
134 secondary roller bearing element
135 retention ring
136 mounting feature
138 aperture
140 ball transfer unit receiving aperture
150 mechanical fastener
152 nut
200 omnidirectional exercise platform
210 base member
212 top surface
214 bottom surface
216 sidewall
220 pad member
222 top surface
224 bottom surface
226 sidewall
230 ball transfer unit
231 ball transfer unit housing
240 ball transfer unit receiving aperture
250 mechanical fastener
252 nut
260 T-shaped handle
262 bollard
264 bollard
266 bollard
272 distal bollard end
274 distal bollard end
276 distal bollard end
282 bollard passage aperture
284 bollard passage aperture
286 bollard passage aperture
292 bollard end receiving cavity
294 bollard end receiving cavity
296 bollard end receiving cavity
300 co-planar lines
310 rotational line
320 vertically oriented rotational axis
400 user
410 support surface
500 triangular shaped omnidirectional exercise platform
510 upper body member
512 upper body member top surface
514 upper body member underside
515 lower body member receiving rabbet
516 upper body member sidewall
517 upper body member sidewall bottom edge
518 upper body member sidewall upper edge
520 pad member
522 pad member top surface
524 pad member bottom surface
526 pad member sidewall

528 pad member retention feature
529 pad member central registration protrusion
530 ball transfer unit
532 primary ball member centroid
540 ball transfer unit receiving socket
542 transverse socket supporting rib
543 transverse socket supporting surface
544 radial socket supporting rib
545 radial socket supporting surface
546 ball transfer unit assembly receiving tab
547 ball transfer unit assembly receiving slot
550 assembly snap hook
552 hook latch aperture
560 lower body member
562 lower body member topside
564 lower body member bottom surface
565 lower body assembly ridge
570 sidewall handgrip
572 handgrip supporting rib
574 concave bottom surface
580 upper base member radial assembly support rib
582 upper base member radial assembly support slot
584 lower base member assembly support ridge
586 lower base member assembly support ridge slot
590 upper base member pad receiving cavity
592 pad receiving cavity base
594 pad receiving cavity sidewall
598 pad member retention rabbet
599 pad member central registration receptacle
602 central downward force
604 upward platform supporting force
606 distal triangular platform downward force
608 distal circular platform downward force
610 triangular platform peripheral boundary
611 triangular platform distal edge
616 triangular platform maximum instability region
618 circular platform maximum instability region
620 platform pad member peripheral boundary
621 platform pad member tangential edge
622 interior stability indicator
624 raised ring
626 recessed ring
630 ball member defined stability binding region
631 ball member stability binding region tangential edge
650 circular platform outline
651 circular platform tangential edge
662 platform pad instability margin
664 platform body instability margin
665 platform defined pad frame segment
666 circular platform instability margin
667 circular platform extension actual dimension
668 circular platform extension effective dimension

What is claimed is:

1. An omnidirectional exercise platform for facilitating a physical training exercise, comprising:

a base member having a top surface, an opposite bottom surface and a sidewall extending between a peripheral region of said top surface and a peripheral region of said opposite bottom surface;

a contact surface defined by a peripheral edge, said contact surface provided on said top surface of said base member; and three ball transfer unit receiving sockets formed extending inward from said bottom surface of said base member, each of said three ball transfer unit receiving sockets being located defining corners of an equilateral triangle; and three ball transfer units, each ball transfer unit being assembled within a respective ball transfer unit receiving socket of said three ball transfer unit receiving sockets, each ball transfer unit comprising a spherical ball member having a centroid, wherein said contact surface peripheral edge is positioned outwardly from a center of said omnidirectional exercise platform to a position substantially aligned with or inward of each ball transfer unit centroid, thus ensuring said omnidirectional exercise platform maintains stability against a support surface when a user grips the omnidirectional exercise platform at any position on the contact surface, wherein said plurality of ball transfer units substantially reduces rolling resistance when said omnidirectional exercise platform is loaded over a support surface during the physical training exercise.

2. An omnidirectional exercise platform as recited in claim 1, wherein a geometric intersection of each centroid of each spherical ball member define a stability binding region, wherein said contact surface further comprises a grip location indicator that is entirely within said stability binding region.

3. An omnidirectional exercise platform as recited in claim 1, wherein said contact surface has a shape and a size positioned, locating said contact surface peripheral edge proximate to or within an interior side of each centroid of each respective ball transfer unit.

4. An omnidirectional exercise platform as recited in claim 1, said contact surface is raised beyond said base member top surface about said contact surface peripheral edge.

5. An omnidirectional exercise platform as recited in claim 1, wherein said contact surface is manufactured of a pliant material.

6. An omnidirectional exercise platform as recited in claim 1, wherein said base member top surface is formed having a convex arched upper surface.

7. An omnidirectional exercise platform as recited in claim 1, wherein said base member sidewall is formed having frustum shape, wherein a bottom edge of said base member sidewall is longer than an upper edge of said base member sidewall.

8. An omnidirectional exercise platform for facilitating a physical training exercise, comprising:

a base member having a convex arch-shaped top surface, an opposite bottom surface and a sidewall extending between a peripheral region of said top surface and a peripheral region of said opposite bottom surface;

a contact surface defined by a peripheral edge, said contact surface provided on said top surface of said base member; and three ball transfer unit receiving sockets formed extending inward from said bottom surface of said base member, each of said three ball transfer unit receiving sockets being located defining corners of an equilateral triangle; and three ball transfer units, each ball transfer unit being assembled within a respective ball transfer unit receiving socket of said three ball transfer unit receiving sockets, each ball transfer unit comprising a spherical ball member having a centroid, wherein said contact surface peripheral edge is positioned outwardly from a center of said omnidirectional exercise platform to a position substantially aligned with or inward of each ball transfer unit centroid, thus ensuring said omnidirectional exercise platform maintains stability against a support surface when a user grips the omnidirectional exercise platform at any position on the contact surface, wherein said plurality of ball transfer units substantially reduces rolling resistance when said omnidirectional exercise platform is loaded over a support surface during the physical training exercise.

9. An omnidirectional exercise platform as recited in claim 8, wherein a geometric intersection of each centroid of each spherical ball member define a stability binding region, wherein said contact surface further comprises a grip location indicator that is entirely within said stability binding region.

10. An omnidirectional exercise platform as recited in claim 8, wherein said contact surface shape being sized and positioned locating said peripheral edge of said contact surface on an interior side of each centroid of each respective ball transfer unit.

11. An omnidirectional exercise platform as recited in claim 8, said contact surface is raised beyond said base member top surface about said contact surface peripheral edge.

12. An omnidirectional exercise platform as recited in claim 8, wherein said contact surface is manufactured of a pliant material.

13. An omnidirectional exercise platform as recited in claim 8, wherein said base member top surface is formed having a convex arched upper surface.

14. An omnidirectional exercise platform as recited in claim 8, wherein said base member sidewall is formed having a frustum shape, wherein a bottom edge of said base member sidewall is longer than an upper edge of said base member sidewall.

15. An omnidirectional exercise platform for facilitating a physical training exercise, comprising:

a base member comprising an upper body member and a lower body member detachably assembled to one another, said base member having a top surface, an opposite bottom surface and a sidewall extending between a peripheral region of said top surface and a peripheral region of said opposite bottom surface;

a contact surface defined by a peripheral edge, said contact surface provided on said top surface of said base member; and three ball transfer unit receiving sockets formed extending inward from said bottom surface of said base member, each of said three ball transfer unit receiving sockets being located defining corners of an equilateral triangle; and three ball transfer units, each ball transfer unit being assembled within a respective ball transfer unit receiving socket of said three ball transfer unit receiving sockets, each ball transfer unit comprising a spherical ball member having a centroid, wherein said contact surface peripheral edge is positioned outwardly from a center of said omnidirectional exercise platform to a position substantially aligned with or inward of each ball transfer unit centroid, thus ensuring said omnidirectional exercise platform maintains stability against a support surface when a user grips the omnidirectional exercise platform at any position on the contact surface, wherein said plurality of ball transfer units substantially reduces rolling resistance when said omnidirectional exercise platform is loaded over a support surface during the physical training exercise.

16. An omnidirectional exercise platform as recited in claim 15, wherein a geometric intersection of each centroid of each spherical ball member define a stability binding region, wherein said contact surface further comprises a grip location indicator that is entirely within said stability binding region.

17. An omnidirectional exercise platform as recited in claim 15, wherein said contact surface shape being sized and positioned locating said peripheral edge of said contact surface on an interior side of each centroid of each respective ball transfer unit.

18. An omnidirectional exercise platform as recited in claim 15, said contact surface is raised beyond said base member top surface about said contact surface peripheral edge.

19. An omnidirectional exercise platform as recited in claim 15, wherein said base member top surface is formed having a convex arched upper surface.

20. An omnidirectional exercise platform as recited in claim 15, wherein said base member sidewall is formed having a frustum shape, wherein a bottom edge of said base member sidewall is longer than an upper edge of said base member sidewall.

* * * * *